US012722745B2

(12) United States Patent
Hooper et al.

(10) Patent No.: US 12,722,745 B2
(45) Date of Patent: Sep. 1, 2026

(54) REMOTE LAUNCHER FOR UNMANNED WATER-BASED DEPLOYABLES

(71) Applicant: The United States of America, as represented by the Secretary of the Navy, Arlington, VA (US)

(72) Inventors: Ralph David Hooper, Lemon Grove, CA (US); William Chambers, Jamul, CA (US); Christopher Zirkle, Oceanside, CA (US); Taylor Doolittle, San Diego, CA (US); Kelly Fisher, Imperial Beach, CA (US); Karl Anders Lindman, Chula Vista, CA (US); Joshua James Erick, San Diego, CA (US); Kelly Krueger, La Mesa, CA (US)

(73) Assignee: United States of America, as represented by the Secretary of the Navy, Washington, DC (US)

( * ) Notice: Subject to any disclaimer, the term of this patent is extended or adjusted under 35 U.S.C. 154(b) by 212 days.

(21) Appl. No.: 18/894,307

(22) Filed: Sep. 24, 2024

(65) Prior Publication Data

US 2026/0084787 A1 Mar. 26, 2026

(51) Int. Cl.

| | |
|---|---|
| ***B63B 35/40*** | (2006.01) |
| ***B63B 22/00*** | (2006.01) |
| ***B63B 79/10*** | (2020.01) |
| ***B63B 79/40*** | (2020.01) |
| *B63B 35/00* | (2020.01) |

(52) U.S. Cl.

CPC ..... *B63B 22/003* (2013.01); *B63B 35/40* (2013.01); *B63B 79/10* (2020.01); *B63B 79/40* (2020.01); *B63B 2035/006* (2013.01)

(58) Field of Classification Search

CPC ..... B63B 35/40; B63B 79/10; B63B 79/40; B63B 22/003; B63B 2035/006

See application file for complete search history.

(56) References Cited

U.S. PATENT DOCUMENTS

| | | | | |
|---|---|---|---|---|
| 7,231,862 | B1 * | 6/2007 | Quinn | F41G 3/06 89/205 |
| 7,472,866 | B2 * | 1/2009 | Heaston | B63G 8/28 89/1.81 |
| 8,205,828 | B2 * | 6/2012 | Bossert | F41F 3/07 114/238 |
| 9,453,705 | B2 * | 9/2016 | Sylvia | B63G 8/001 |
| 11,254,402 | B1 * | 2/2022 | Poirier | F02D 41/10 |

(Continued)

*Primary Examiner* — S. Joseph Morano
*Assistant Examiner* — Jovon E Hayes
(74) *Attorney, Agent, or Firm* — Naval Information Warfare Center, Pacific; Kyle Eppele; Andrew J. Cameron

(57) ABSTRACT

A remote launcher includes a base frame, a cradle, a cradle actuator, and a launch control system. The cradle is pivotably coupled to the base frame and includes one or more skids that are configured to receive and support an unmanned water-based deployable. The cradle actuator is coupled to the base frame and to the cradle. The launch control system includes a communication interface, a processor, and memory having instructions. The instructions direct the launch control system to receive, via the communication interface, one or more wireless launch signals and then, in response thereto, generate at least one cradle control signal to enable the cradle actuator to incline the cradle to a launch angle.

20 Claims, 16 Drawing Sheets

(56) References Cited

U.S. PATENT DOCUMENTS

| | | | | |
|---|---|---|---|---|
| 12,235,067 | B1 * | 2/2025 | Anderson | F41A 9/11 |
| 12,442,622 | B1 * | 10/2025 | Anderson | F41B 3/02 |
| 2005/0151009 | A1 * | 7/2005 | Roeseler | B63B 35/50 244/63 |
| 2013/0007935 | A1 * | 1/2013 | Chin | B64G 1/005 244/33 |
| 2017/0225802 | A1 * | 8/2017 | Lussier | B60L 53/36 |
| 2018/0107210 | A1 * | 4/2018 | Harnett | B63B 35/00 |
| 2021/0237833 | A1 * | 8/2021 | Childress | B63B 27/16 |
| 2021/0237836 | A1 * | 8/2021 | Childress | B63C 1/02 |
| 2025/0117008 | A1 * | 4/2025 | Hanson | B63B 1/32 |
| 2025/0304218 | A1 * | 10/2025 | Jekimov | B63B 79/15 |

* cited by examiner

REMOTE LAUNCHER FOR UNMANNED WATER-BASED DEPLOYABLES

FEDERALLY-SPONSORED RESEARCH AND DEVELOPMENT

The United States Government has ownership rights in one or more inventions provided in this disclosure. Licensing inquiries may be directed to Office of Research and Technical Applications, Naval Information Warfare Center Pacific, Code 72110, San Diego, CA, 92152; (619) 553-5118; NIWC_Pacific_T2@us.navy.mil. Reference Navy Case No. 211705

TECHNICAL FIELD

Aspects of the present disclosure relate generally to launching systems and platforms for unmanned water-based vehicles and other deployables, and in particular but not exclusively, relate to such launching systems that include wireless communication interfaces.

BACKGROUND OF THE INVENTION

An Unmanned Surface Vehicle (USV) is a drone, boat, or ship that operates on the surface of the water without an onboard crew. USVs have seen increased maritime uses (e.g., oceanographic, scientific, oil and gas, defense, etc.), especially with the proliferation of advanced USV technology and capabilities as well as a reduction in associated costs. USVs may be delineated by size and weight class and further subdivided into remotely operated surface vehicles (ROSV) and autonomous surface vehicles (ASV). The uses for these types of USVs continues to expand. For instance, one proposed use for USVs is to carry and transport unmanned water-based deployables, such as unmanned underwater vehicles (UUV), other USVs, buoys, or transponders. However, some USVs require the physical presence of a human operator in order to launch the water-based deployable from the USV. For example, a UUV may be transported on a USV that requires a user to physically operate a hand-crank or other mechanism in order to offload the UUV into the water. Requiring a user to be physically present at the USV in order to launch its cargo may limit the usefulness and reduce the apparent benefits of such unmanned vehicles.

BRIEF DESCRIPTION OF THE DRAWINGS

Non-limiting and non-exhaustive embodiments of the invention are described with reference to the following figures, wherein like reference numerals refer to like parts throughout the various views unless otherwise specified.

DETAILED DESCRIPTION

Figure 1A:
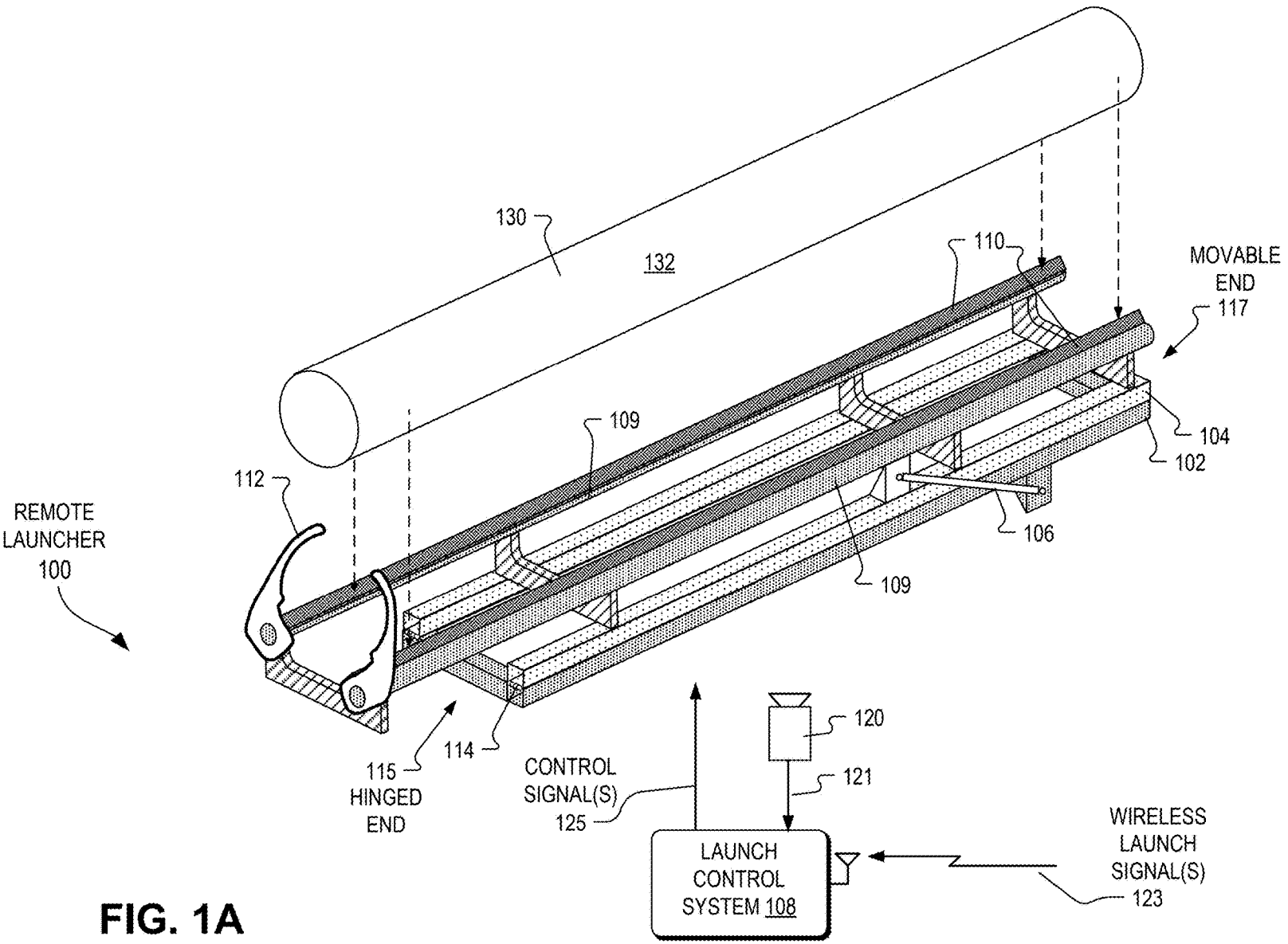
FIG. 1A illustrates an example remote launcher, in accordance with aspects of the disclosure.

Embodiments of a remote launcher, a remote launcher platform, and a remote launch system, for launching an unmanned water-based deployable are described herein. In the following description, numerous specific details are set forth to provide a thorough understanding of the embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As mentioned above, one possible use for an unmanned surface vehicle (USV) is to carry and transport an unmanned water-based deployable. As used herein, an unmanned water-based deployable may include a unmanned underwater vehicle (UUV), another USV, a buoy, a transponder or any other item/device that may need to be deployed in a water environment. However, some USVs may require the physical presence of an operator in order to launch an unmanned water-based deployable from the USV, which may limit the time, place, and location in which the water-based deployable may be launched and used.

Accordingly, aspects of the present disclosure provide a remote launcher for such unmanned water-based deployables. For example, a remote launcher may include a cradle that includes skids for receiving and supporting the deployable during transit. The remote launcher also includes a cradle actuator that is configured to incline the cradle in response to a wirelessly received launch signal. In some aspects, the cradle actuator inclines the cradle to a launch angle that is large enough to initiate a gravity-assisted transit of the deployable along the skids and into the water. A remote launcher, as provided herein, may enable launch evolutions of an unmanned water-based deployable that are faster and safer, as well as omit the requirement for an operator to be physically present.

In addition, the remote launcher may be platform agnostic. That is, the remote launcher may operate independently of the host vehicle/vessel (e.g., USV) on which the remote launcher is placed. For example, the remote launcher may include its own launch control system that includes a communication interface for receiving and/or sending wireless communications separate from those that may or may not be provided by the host vessel. Thus, aspects of the present disclosure may allow a remote launcher to be placed/incorporated onto a variety of different host vessels (e.g., variety of different USVs) regardless of their configuration and/or communication capabilities. These and other aspects of the present disclosure will be described in more detail below.

FIG. 1A illustrates an example remote launcher 100, in accordance with aspects of the disclosure. Remote launcher 100 is shown as including a base frame 102, a cradle 104, a cradle actuator 106, and a launch control system 108. The example cradle 104 is shown as including support members 109, skids 110, a clamping device 112, at least one hinge 114, a hinged end 115, and a movable end 117. Also shown in FIG. 1A is an optional camera 120, one or more images 121, wireless launch signal(s) 123, control signal(s) 125, and an unmanned water-based deployable 130 having an exterior surface 132.

As shown in FIG. 1A, remote launcher 100 includes a base frame 102. Base frame 102 may be sized and shaped to be placed on the deck of a host vehicle/vessel, such as a USV. In some implementations, base frame 102 includes one or more spacers, shock absorbers, pads, and/or mounting features (not shown in FIG. 1A) disposed on an underneath side of the base frame 102. Base frame 102 may be a rigid material such as metal. For example, base frame 102 may constructed from a square tubular metal, such as aluminum.

FIG. 1A further illustrates remote launcher 100 as including a cradle 104. Although FIG. 1A illustrates remote launcher 100 as including a single cradle 104, remote launcher 100 may include any number of cradles 104, including one or more to transport and independently launch a plurality of separate unmanned water-based deployables. In some aspects, cradle 104 is pivotably coupled to the base frame 102. For example, cradle 104 may include one or more hinges 114 for pivotably attaching cradle 104 to the base frame 102 at the hinged end 115 of the cradle 104. Cradle 104 is also shown as including a movable end 117 that is opposite (i.e., distal) from the hinged end 115. In some aspects, the moveable end 117 of cradle 104 is not fixedly attached to the base frame 102 in order to allow the cradle 104 to be inclined towards the hinged end 115 (e.g., see FIG. 1B).

As further shown in FIG. 1A, cradle 104 includes one or more skids 110. Skids 110 are configured to receive and support the unmanned water-based deployable 130. In some examples, skids 110 are attached to one or more support members 109. Support members 109 may be a rigid material such as metal. For example, support members 109 may be a round tubular metal, such as aluminum. In some implementations, skids 110 include a marine-grade, low-friction material that is disposed on the support members 109 to contact the exterior surface 132 of the unmanned water-based deployable 130. For instance, skids 110 may be a nylon, a polymer, or an acetal homopolymer, etc.

FIG. 1A also shows cradle 104 as including a clamping device 112. In some aspects clamping device 112 is coupled to the support members 109. In particular, each jaw of the clamping device 112 may be coupled to rotate about a respective support member 109. Although FIG. 1A illustrates clamping device 112 disposed near the hinged end 115, in other embodiments clamping device 112 may be disposed anywhere along the support members 109, from the hinged end 115 to the movable end 117. Clamping device 112 may be controlled/actuated between a closed state and an open state. When in the closed state, clamping device 112 contacts the exterior surface 132 to secure the unmanned water-based deployable 130 to the cradle 104. When in the open state, clamping device 112 disengages (i.e., no longer contacts the surface 132) to allow the unmanned water-based deployable 130 to freely traverse (e.g., slide on) the skids 110.

Remote launcher 100 is also shown as including a cradle actuator 106. Cradle actuator 106 is coupled to the base frame 102 and to the cradle 104. In some aspects, when enabled, the cradle actuator 106 is configured to exert an upwards force to raise the moveable end 117 to incline the cradle 104.

Figure 1B:
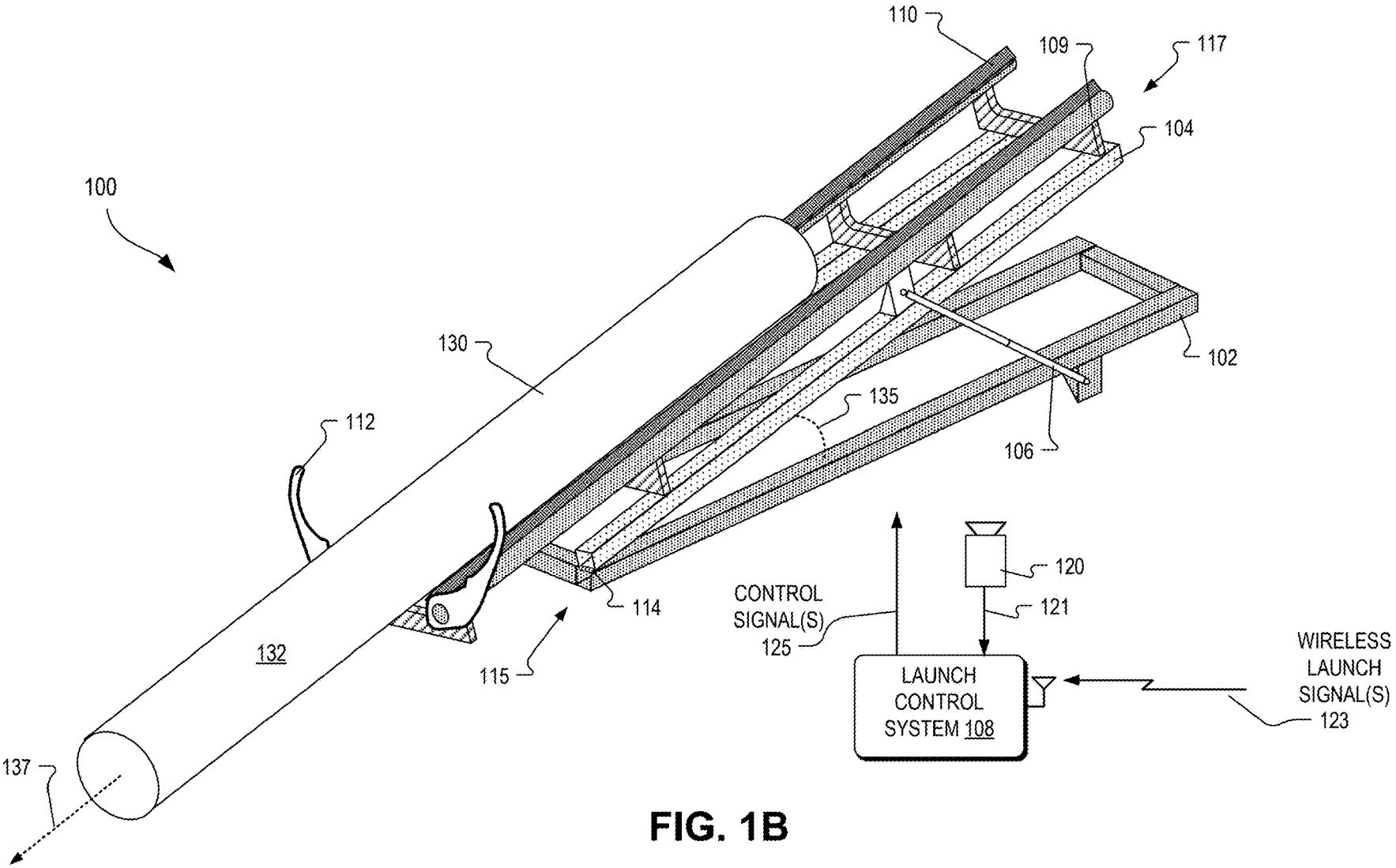
FIG. 1B illustrates the example remote launcher of FIG. 1A launching an unmanned water-based deployable.

For example, FIG. 1A illustrates cradle 104 in a stowed position, where cradle 104 is not inclined with respect to (i.e., substantially parallel to) the base frame 102. In contrast, FIG. 1B illustrates remote launcher 100 launching the unmanned water-based deployable 130 with the cradle 104 in a launch position. When in the launch position, cradle 104 may be inclined to a launch angle 135. The launch angle 135 may be the angle of the cradle 104 with respect to the base frame 102 and/or may be the angle of the support member 109 with respect to the base frame 102. In another example, the launch angle 135 may be the angle of the cradle 104 with respect to a deck of the USV on which the remote launcher 100 is currently deployed. In some aspects, the launch angle 135 is greater than a minimum angle necessary to overcome a coefficient of friction between the surface 132 of the unmanned water-based deployable 130 and the low-friction material of the skids 110. For example, the cradle actuator 106 may be configured to extend itself in response to the control signal(s) 125 to incline the cradle 104 to a launch angle 135 that is large enough to initiate a gravity-assisted transit 137 of the unmanned water-based deployable 130 along the skids 110, off the remote launcher 100, and into the water.

Both the enabling of the cradle actuator 106 and the opening of the clamping device 112 are responsive to one or more control signals 125 generated by the launch control system 108. The launch control system 108 may include a computing device or other hardware that is co-located with the other components of the remote launcher 100. For example, launch control system 108 may be attached to or incorporated within the base frame 102 and/or the cradle 104. The launch control system 108 may be configured to generate the control signals 125 to enable/disable the clamping device 112 and to enable/disable the cradle actuator 106 in response to one or more wireless launch signals 123. Thus, in some examples, launch control system 108 provides a platform agnostic capability of the remote launcher 100. That is, the launch control system 108 may operate independent of and separately from any communication/control system, if any, included on the USV on which the remote launcher 100 is deployed.

Figure 2:
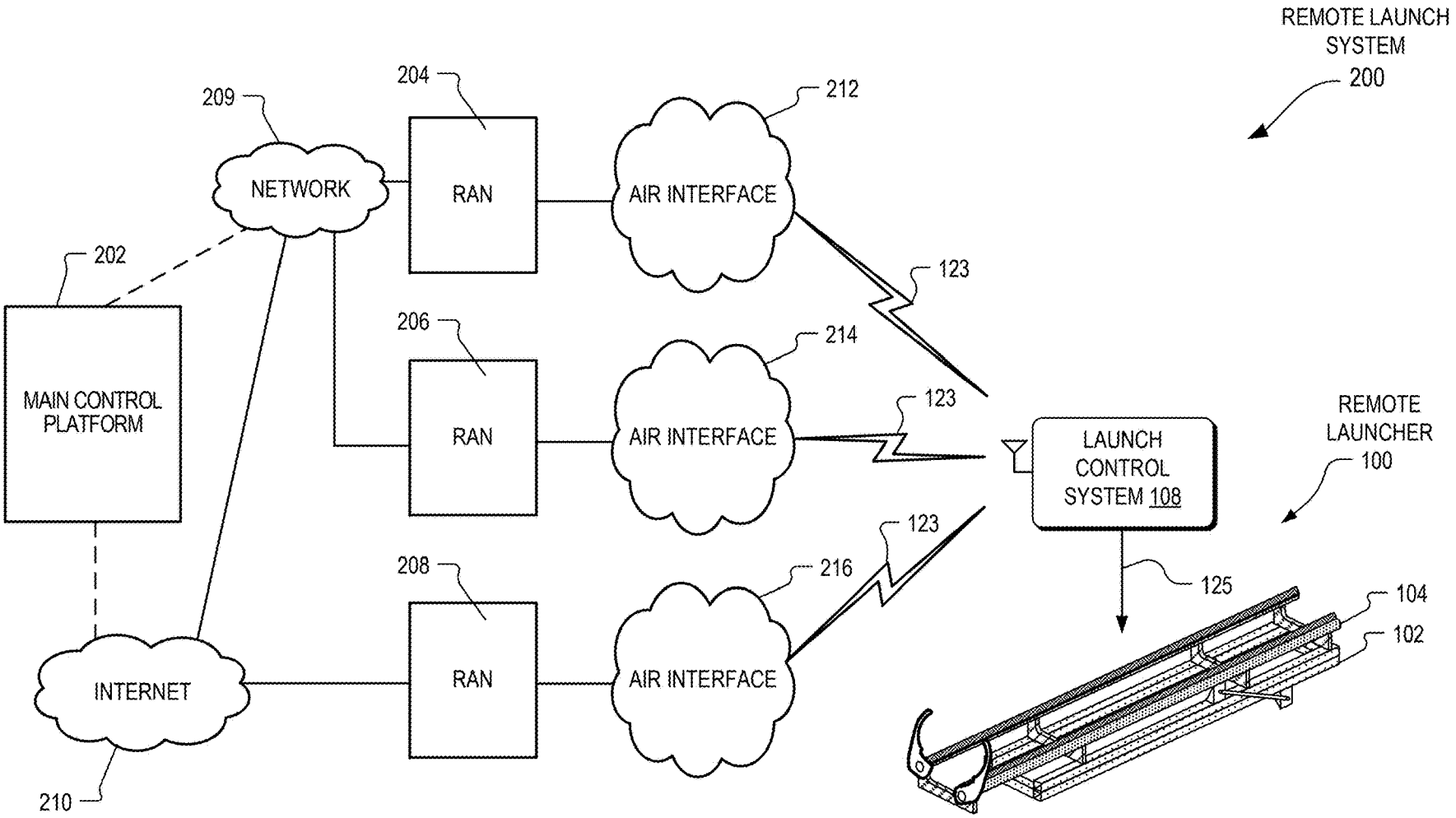
FIG. 2 illustrates a remote launch system, in accordance with aspects of the disclosure.

In some aspects, the one or more wireless launch signals 123 are generated by a main control platform that is physically and geographically separate from the remote launcher 100. In some aspects, the launch control system 108 is configured to communicate with a main control platform to receive the wireless launch signals 123 via a radio access network (RAN). For example, FIG. 2 illustrates a remote launch system 200, in accordance with aspects of the disclosure that includes the remote launcher 100 and a main control platform 202. Also shown in FIG. 2 are a RAN 204, a RAN 206, a RAN 208, network 209, Internet 210, and air interfaces 212, 214, and 216.

In some aspects, main control platform 202 is a computing device and/or other hardware that is configured to generate and communicate one or more wireless launch signals 123 with an access network (e.g., the RAN 204, RAN 206, RAN 208, etc.) over a physical communications interface or layer, shown in FIG. 2 as air interfaces 212, 214, and 216. Air interfaces 212, 214, and 216 may each comply with a given wireless communications protocol. For example, air interface 212 and/or air interface 214 may comply with a radio frequency communication protocol (e.g., UHF/VHF line-of-sight (LOS) or beyond-line-of-sight (BLOS)), a satellite communication protocol, a wireless IP protocol (e.g., IEEE 802.11, MUOS WCDMA, etc.), a common data link (CDL) protocol, or an optical communications protocol, just to name a few). In some aspects, main control platform 202 is connected to the Internet 210, to the network 209, or both. The main control platform 202 may be implemented as a plurality of structurally separate devices/servers, or alternately may correspond to a single device/server.

RANs 204 and 206 may each include one or more access points that serve the launch control system 108 over the air interfaces 212 and 214. The access points of RANs 204 and 206 may be referred to as access nodes, access points, base stations, and so on. These access points can be terrestrial access points (land-based or ocean-based stations), satellite access points, and/or mobile access points (e.g., land, air, or water-based vehicles, etc.). The RANs 204 and 206 are shown as connected to a network 209. In some aspects, network 209 includes a number of routing agents and processing agents. The network 209 may be a local or global system of interconnected computers and computer networks that uses a common communication protocol over digital interconnections. For example, network 209 may utilize an Internet protocol suite (e.g., the Transmission Control Protocol (TCP) and IP) for communication among disparate devices and networks.

The network 209 may be configured to perform a variety of functions, such as bridging the transfer of data and/or other information between the main control platform 202 and the launch control system 108. In addition, the network 209 may be configured to mediate the exchange of data with an external network, such as Internet 210. The Internet 210 may include a number of routing agents and processing agents. In some examples, launch control system 108 may connect to the Internet 210 directly via air interface 216 and RAN 208 (i.e., separate from network 209). In some examples, air interface 216 may comply with a given cellular communications protocol (e.g., CDMA, EVDO, eHRPD, GSM, EDGE, W-CDMA, 4G LTE, 5G LTE, 5G New Radio (NR)), a commercial satellite communications protocol, an Ethernet connection of WiFi or 802.11-based network, etc.). Thus, in some examples, the Internet 175 may function to bridge data communications between the launch control system 108 and the main control platform 202.

Figure 3:
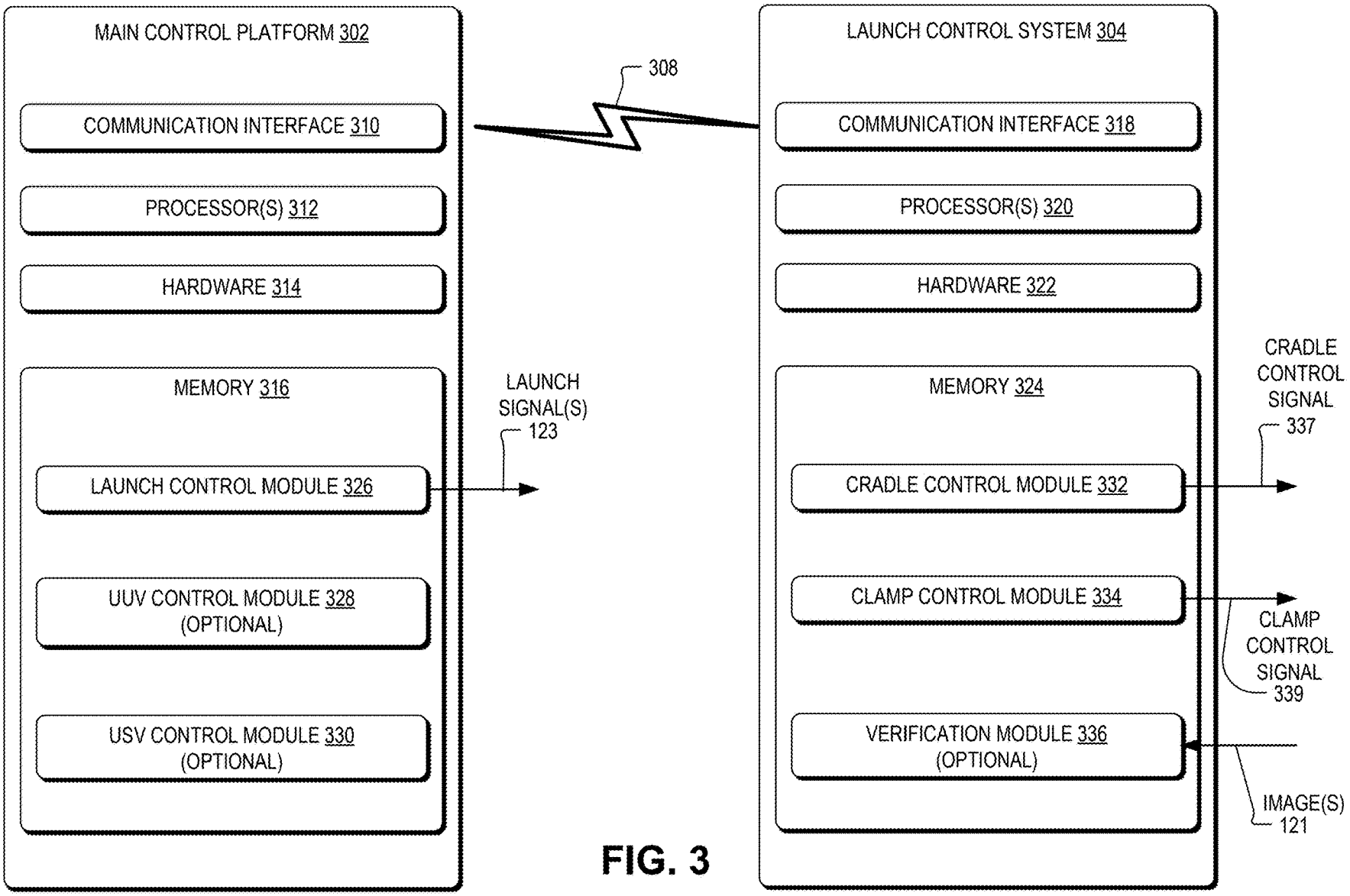
FIG. 3 illustrates an example main control platform and an example launch control system, in accordance with aspects of the disclosure.

FIG. 3 illustrates an example main control platform 302 and an example launch control system 304, in accordance with aspects of the disclosure. Main control platform 302 is one possible implementation of main control platform 202 of FIG. 2. Launch control system 304 is one possible implementation of launch control system 108 of FIGS. 1 and 2. The main control platform 302 of FIG. 3 is shown as including a communication interface 310, one or more processors 312, hardware 314, and a memory 314. The launch control system 304 is shown as including a communication interface 318, one or more processors 320, hardware 322, and a memory 324. Also shown in FIG. 3 is a wireless link 308, launch signals 123, cradle control signal 337, clamp control signal 339, and images 121.

In the example of FIG. 3, the main control platform 302 and the launch control system 304 each generally include a communication interface (represented by the communication interfaces 310 and 318) for communicating with each other and/or with other network nodes. The communication interfaces 310 and 318 may be variously configured for transmitting and encoding signals (e.g., messages, indications, information, and so on), and, conversely, for receiving and decoding signals (e.g., messages, indications, information, pilots, and so on) in accordance with the designated wireless protocol. For example, the communication interface 310 may transmit and receive messages that are ultimately communicated via a wireless link 308 with the communication interface 318 of the launch control system 304. Such messaging may include information related to various types of communication (e.g., data, associated control signaling, etc.), such as one or more launch signals 123. The wireless link 308 may operate over an air interface of interest, such as any of the air interfaces 212-216 of FIG. 2.

The hardware 314 and hardware 322 may each include additional hardware interfaces, data communication, or data storage hardware. For example, the hardware interfaces may include a data output device (e.g., electronic display, audio speakers), and one or more data input devices (e.g., keypads, keyboards, mouse devices, touch screens, microphones, etc.).

The processor 312 of main control platform 302 may execute instructions and perform tasks under the direction of software components that are stored in memory 316. Similarly, the processor 320 of launch control system 304 may execute instructions and perform tasks under the direction of software components that are stored in memory 324. For example, the memory 316 may store various software components that are executable or accessible by the one or more processors 312, where these various components may include a launch control module 326, an optional UUV control module 328, and an optional USV control module 330. Similarly, the memory 324 may store various software components that are executable or accessible by the one or more processors 320, where these various components may include a cradle control module 332, a clamp control module 334, and a verification module 336.

The launch control module 326, the UUV control module 328, and the USV control module 330 may include routines, program instructions, objects, and/or data structures that perform particular tasks or implement particular abstract data types. For example, the launch control module 326 may include one or more instructions, which when executed by the one or more processors 312 direct the main control platform 302 to perform operations related to generating and transmitting one or more launch signals 123 via wireless link 308. In some aspects, the launch control module 326 is configured to receive user input that indicates that a launch is to be initiated, where the launch control module 326 then generates the launch signal 123 in response thereto. In some implementations, launch control module 326 is configured to automatically generate the launch signal 123 based on one or more criteria (e.g., remote launcher location, time, status, etc.). For example, the launch control module 326 may be configured to receive data via wireless link 308 from the launch control system 304 regarding the status of the remote launcher itself (e.g., remote launcher location, cradle status, clamp status, etc.). Thus, the main control platform 302 may receive the remote launcher status that then automatically triggers generation of one or more of the launch signals 123.

In addition, in some implementations, the UUV control module 328 is included in the main control platform 302 to monitor, control, or otherwise exchange data with a UUV or other unmanned water-based deployable that is currently stowed on and to be launched from a remote launcher, such as remote launcher 100 of FIG. 1. Similarly, in some implementations, the USV control module 330 is included in the main control platform 302 to monitor, control, or otherwise exchange data with a USV on which the remote launcher is mounted.

With regards to the illustrated example of the launch control system 304, the cradle control module 332, the clamp control module 334, and the optional verification module 336 may include routines, program instructions, objects, and/or data structures that perform particular tasks or implement particular abstract data types. For example, the cradle control module 332 may include one or more instructions, which when executed by the one or more processors 320 direct the launch control system 304 to generate a cradle control signal 337. In some implementations, the cradle control signal 337 is configured to enable a cradle actuator (e.g., cradle actuator 106 of FIG. 1B) to incline the cradle to a launch angle. Similarly, clamp control module 334 may include one or more instructions to direct the launch control system 304 to generate a clamp control signal 339 to transition a clamping device (e.g., clamping device 112 of FIG. 1B) to an open state. Cradle control signal 337 and clamp control signal 339, collectively, are possible implementations of control signals 125 of FIGS. 1A and 1B.

Further details regarding the operation of the launch control module 326, the cradle control module 332, the clamp control module 334, as well as other modules of the launch control system 304 will be described below.

In some implementations, the launch control module 326 of the main control platform 302 is configured to generate and transmit (via wireless link 308) a single launch signal 335. In response to receiving the single launch signal 335, the launch control system 304 may be configured to initiate and complete an entire launch sequence that includes both the clamp control module 334 generating the clamp control signal 339 and the cradle control module 332 generating the cradle control signal 337. The clamping device 112 receives the clamp control signal 339 and in response thereto transitions from a closed state (securing the deployable to the cradle) to an open state (allowing the deployable to freely traverse the skids). Similarly, the cradle actuator 106 enables the inclining of cradle 104 to the launch angle 135 in response to the cradle control signal 337. As mentioned above, having the cradle 104 at the launch angle 135 and having the clamping device 112 in the open state may initiate and allow for a gravity-assisted transit 137 of the deployable along the skids 110 and into the water.

Figure 4:
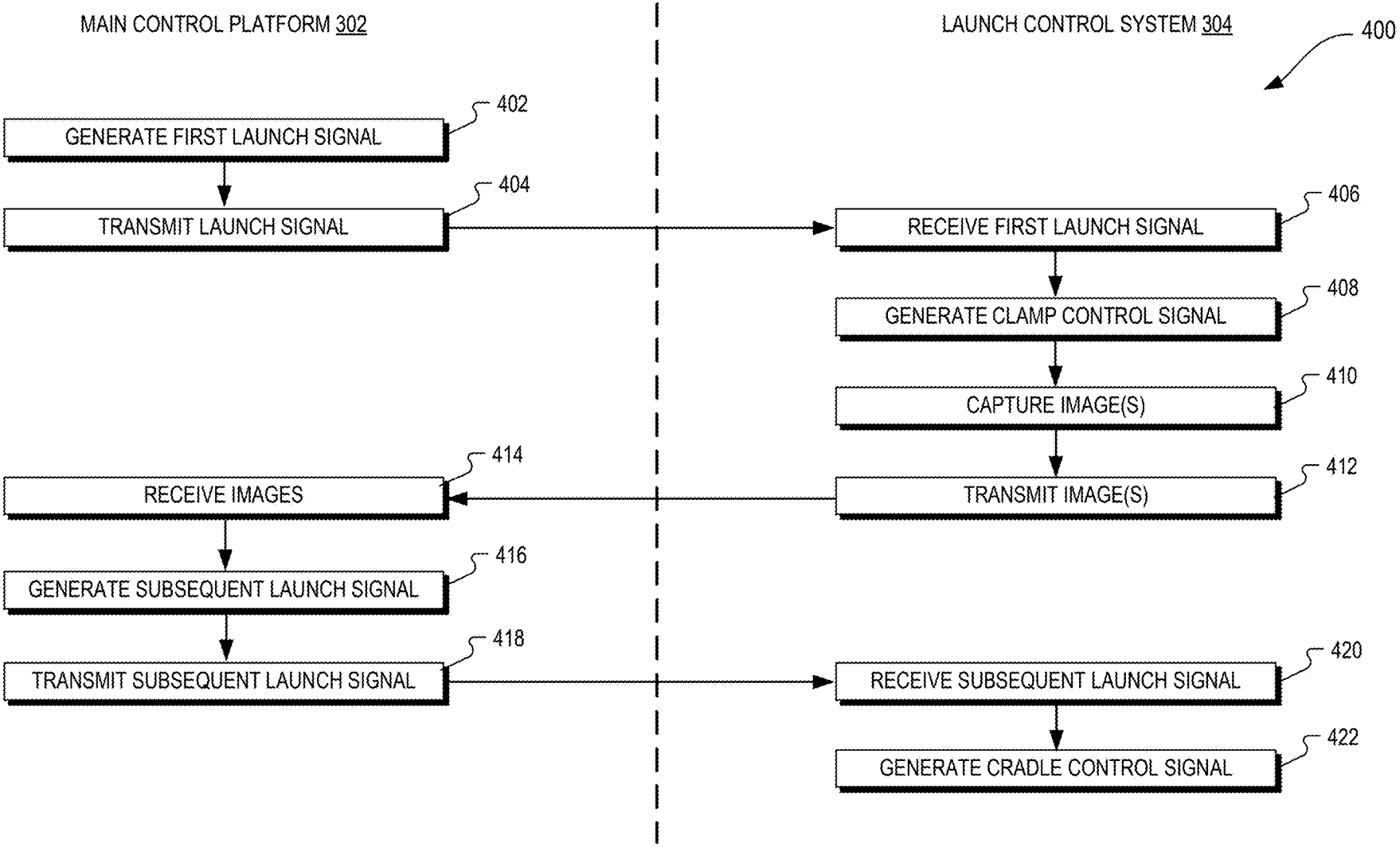
FIG. 4 illustrates an example process performed by the main control platform and the launch control system of FIG. 3, in accordance with aspects of the disclosure.

In another implementation, the launch control module 326 of the main control platform 302 is configured to generate and transmit multiple launch signals 335 for a piecewise control of the launch sequence. For example, the launch control module 326 of the main control platform 302 may be configured to generate and transmit (via wireless link 308) a first launch signal 335, where the clamp control module 334 then generates the clamp control signal 339 to transition the clamping device 112 to the open state in response to the first launch signal 335. The launch control module 326 may then generate a second, subsequent, launch signal 335, where the cradle control module 332 then generates the cradle control signal 337 in response to the second launch signal 335 to enable the cradle actuator 106 incline the cradle 104 to the launch angle 135. In some aspects, the launch control module 326 may implement a time delay between the transmission of the first and second launch signals 335 to allow for the clamping device 112 to open before having the cradle 104 incline to the launch angle 135. In another aspect, the launch control module 326 may verify that one or more steps of the launch sequence have been completed before sending the second or subsequent launch signal 335. Thus, in some implementations, the remote launcher may include one or more sensors for detecting a current state of the clamping device 112, of the cradle 104, and/or of the unmanned water-based deployable 130. For example, referring back to FIG. 1A, the remote launcher 100 may include a camera 120. Camera 120 may be communicatively coupled to launch control system 108. In some examples, camera 120 may be mounted to the base frame 102 or to the cradle 104. The camera 120 may be positioned to capture one or more images 121 of the cradle 104 and/or of the unmanned water-based deployable 130. During operation, the launch control system 108 may receive the one or more images 121 and wirelessly transmit them to the main control platform 302. The main control platform 302 may then receive, display, and or analyze the received images 121 to verify that a previous step of the launch sequence has been completed before sending a second or subsequent wireless launch signal 335. Further details regarding the verification of a launch sequence are provided below with reference to example process 400 of FIG. 4.

In a process block 402, the launch control module 326 generates a first launch signal 335. As mentioned above, the launch control module 326 may be configured to generate the first launch signal 335 in response to user input indicating that a launch of a unmanned water-based deployable is to be initiated. Next, in a process block 404, the communication interface 310 of the main control platform 302 wirelessly transmits the first launch signal 335 over a wireless link 308. In a process block 406, the communication interface 318 of the launch control system 304 receives the first launch signal 335 and then in process block 408, the clamp control module 334 generates the clamp control signal 337 to transition the clamping device 112 to the open state. Next, in process block 410, the camera 120 captures one or more images 121 of the cradle 104 and/or the deployable 130 and provides the images 121 to the verification module 336. In a process block 412, the communication interface 318 wirelessly transmits the one or more images 121 to the main control platform 302 via wireless link 308. In a process block 414, the communication interface 310 of the main control platform 302 receives the images 121. The launch control module 326 may then analyze and/or display the images 121 to a user to verify that the clamping device 112 is indeed in the open state. If so, then process 400 proceeds with process block 416, where the launch control module 326 generates a subsequent launch signal 335, which is then wirelessly transmitted (process block 418) via wireless link 308. In process block 420, the communication interface 318 receives the subsequent launch signal 335, where the cradle control module 332 then generates the cradle control signal 337 to incline the cradle 104 to the launch angle 135. In some examples, the launch control system 304 is configured to continue transmitting the one or more images 121 to the main control platform 302 for verification that the cradle was successfully inclined to the launch angle and/or that the deployable 130 was successfully launched.

Figure 5A:
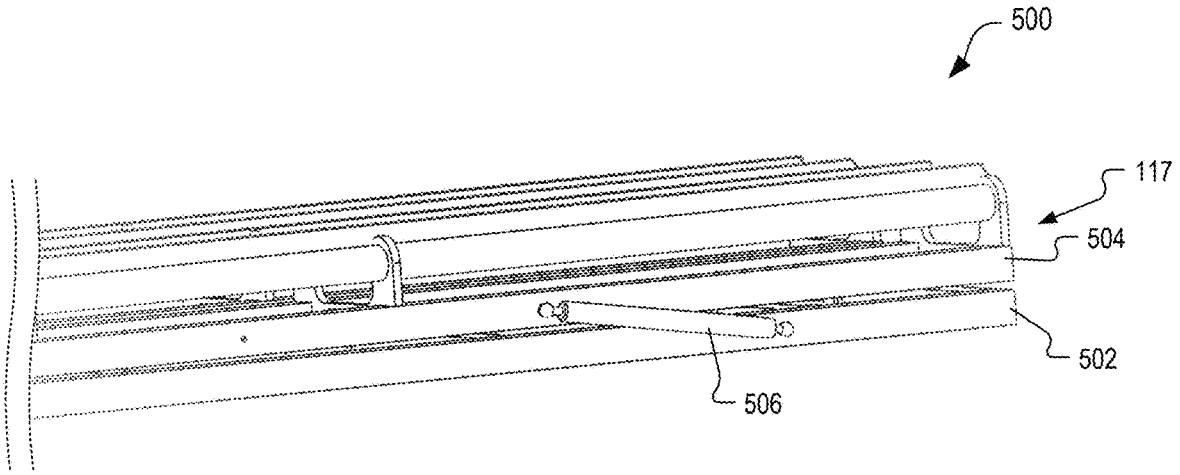
FIG. 5A illustrates an example a remote launcher having a spring, with a cradle in a stowed position, in accordance with aspects of the disclosure.
Figure 5B:
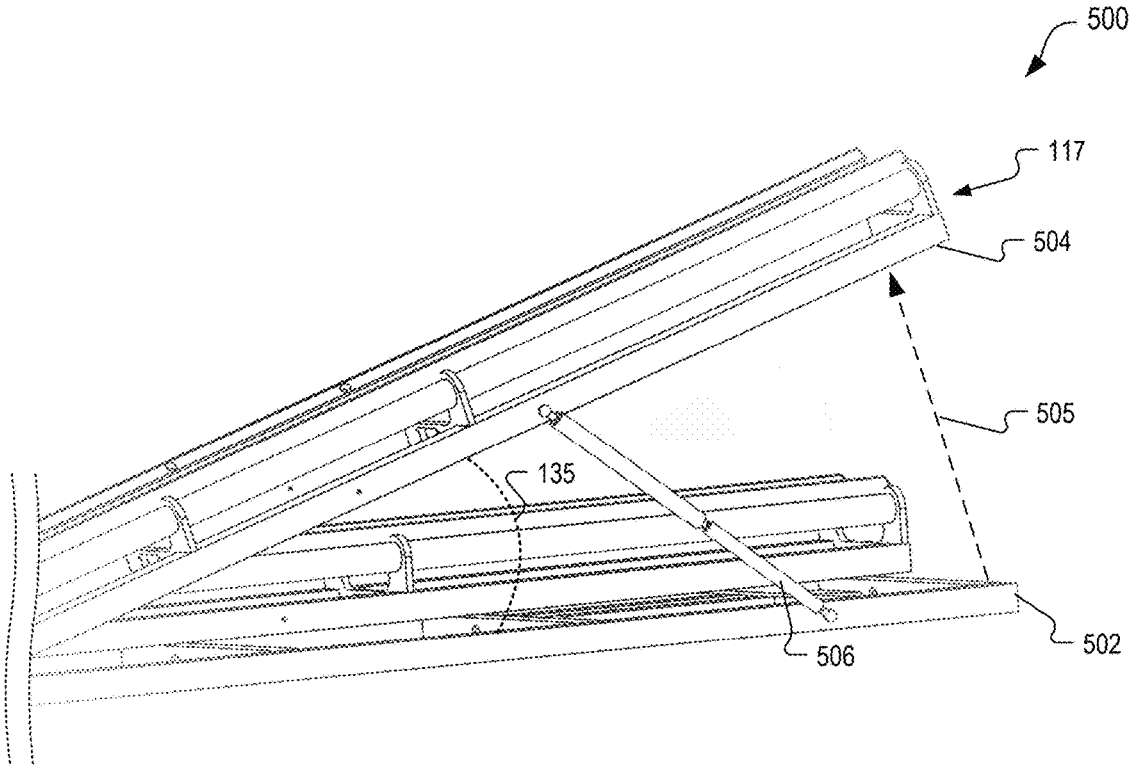
FIG. 5B illustrates the remote launcher of FIG. 5A with the cradle in a launch position.

FIG. 5A illustrates an example a remote launcher 500 having a spring 506, with a cradle 504 in a stowed position, in accordance with aspects of the disclosure. FIG. 5B illustrates the remote launcher 500 of FIG. 5A with the cradle 504 in a launch position. Remote launcher 500 is one possible implementation of remote launcher 100 of FIGS. 1A and 1B. In particular, spring 506 is one possible implementation of cradle actuator 106 of FIGS. 1A and 1B. The illustrated example of remote launcher 500 is shown as including a base frame 502, a cradle 504, and spring 506. As shown in FIG. 5B, spring 506 is coupled to the base frame 502 and to the cradle 504 to bias the cradle 504 towards the launch angle 135. Spring 506 may be a gas spring (e.g., gas strut) in some examples, or may be a coil spring in other examples. When cradle 504 is in the stowed position, as shown in FIG. 5A, the spring 506 may be compressed: biasing the cradle 504 upwards. In some aspects, the remote launcher 500 further includes a latching device that secures the cradle 504 to the base frame 502 to compress the spring 506 and maintain the cradle 504 in the stowed position. The latching device may be configured to release in response to a control signal 125 (e.g., cradle control signal 337) enabling the spring 506 to exert an upwards force 505 to incline the cradle 504 to the launch angle 135.

Figure 5C:
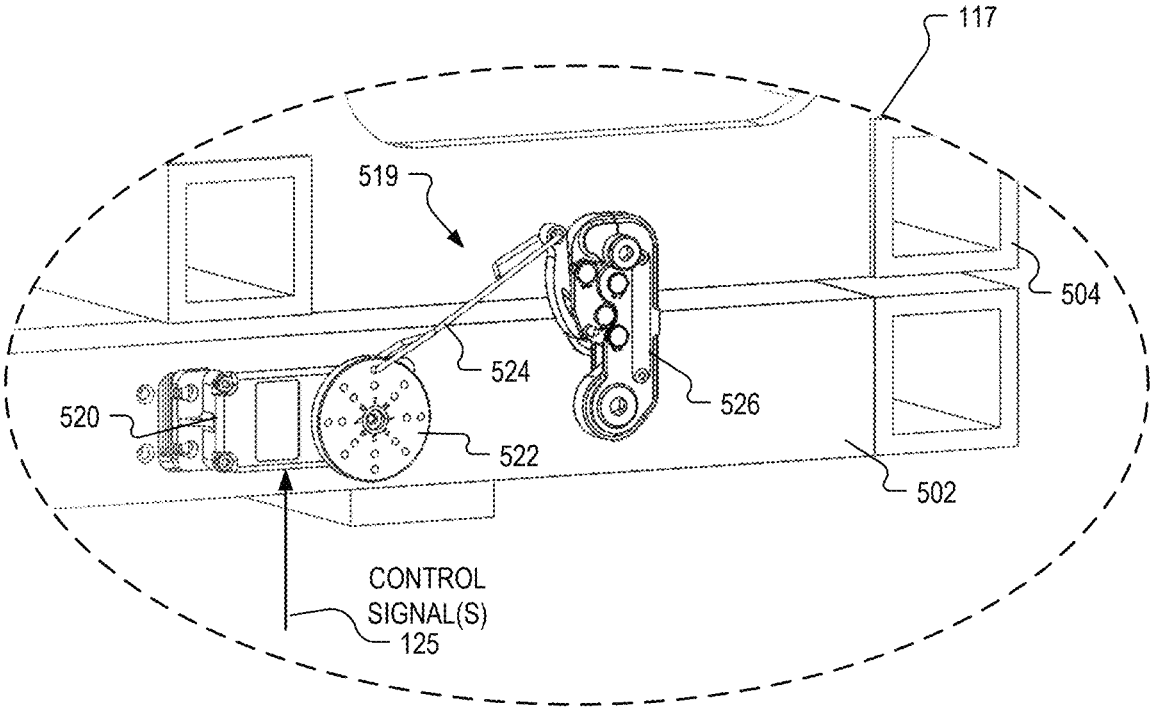
FIG. 5C illustrates an example latching device of a remote launcher, in accordance with aspects of the disclosure.

For example, FIG. 5C is a partial view of the movable end 117 of remote launcher 500 illustrating an example latching device 519, in accordance with aspects of the disclosure. The illustrated example of latching device 519 is shown as including a motor 520, a wheel horn 522, a linkage 524, and a latch 526. The motor 520 may be an electric motor that is configured to be activated in response to the control signal 125. The motor 520 is shown as coupled to the base frame 502. The wheel horn 522 is coupled to the motor 520 to be rotated when the motor 520 is activated. The linkage 524 (e.g., wire, rope, cable, etc.) is coupled between the wheel horn 522 and a release mechanism of latch 526. When activated, the motor 522 rotates the wheel horn 522, which tensions the linkage 524 to release the latch 526. As mentioned above, when released, the cradle 504 is no longer secured to the base frame 502 at the moveable end 117, allowing the spring 506 to incline the cradle 504 to the launch angle 135.

Figure 6A:
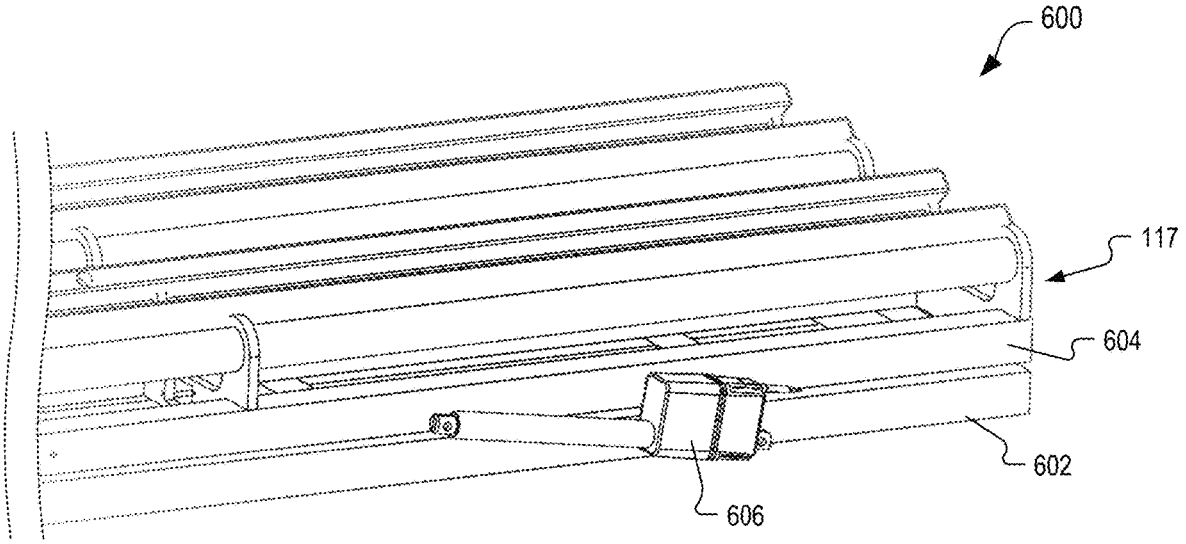
FIG. 6A illustrates an example a remote launcher having a motorized linear actuator, with a cradle in a stowed position, in accordance with aspects of the disclosure.
Figure 6B:
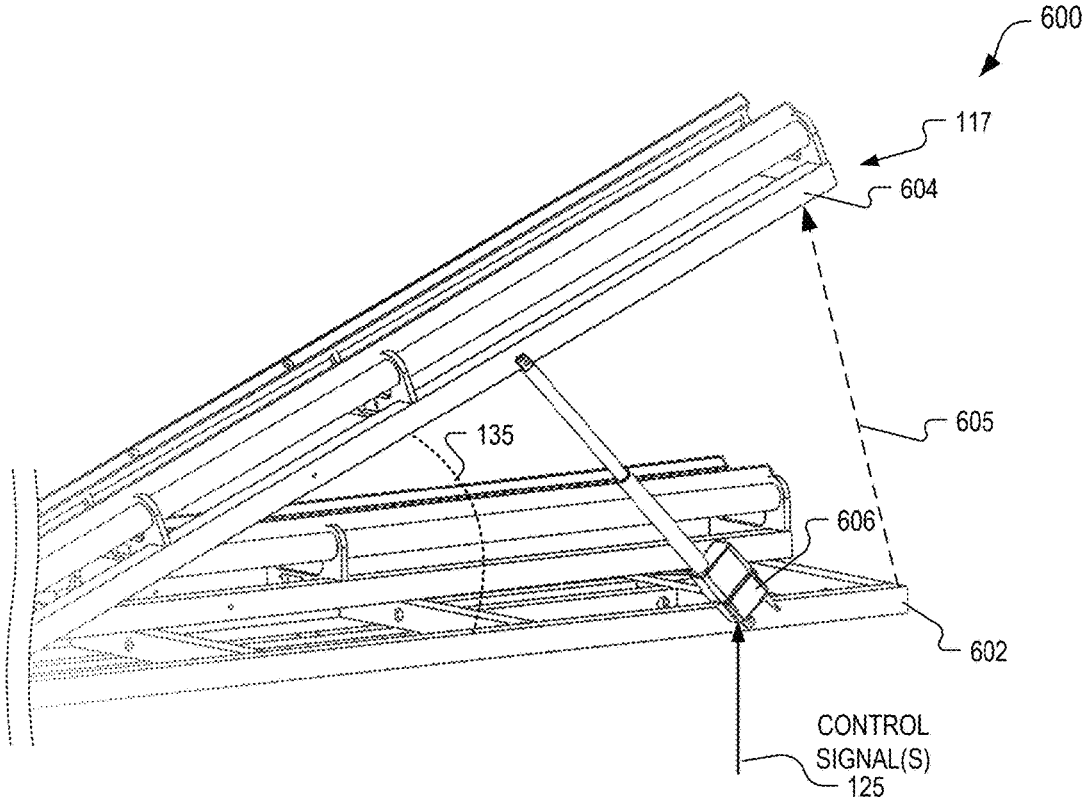
FIG. 6B illustrates the remote launcher of FIG. 6A with the cradle in a launch position.

FIG. 6A illustrates an example a remote launcher 600 having a motorized linear actuator 606, with a cradle 604 in a stowed position, in accordance with aspects of the disclosure. FIG. 6B illustrates the remote launcher 600 of FIG. 6A with the cradle 604 in a launch position. Remote launcher 600 is one possible implementation of remote launcher 100 of FIGS. 1A and 1B. In particular, motorized linear actuator 606 is one possible implementation of cradle actuator 106 of FIGS. 1A and 1B. The illustrated example of remote launcher 600 is shown as including a base frame 602, a cradle 604, and motorized linear actuator 606. As shown in FIG. 6B, motorized linear actuator 506 is coupled to exert an upwards force 605 in response to the control signal 125 (e.g., cradle control signal 337) to incline the cradle 604 to the launch angle 135.

Figure 7A:
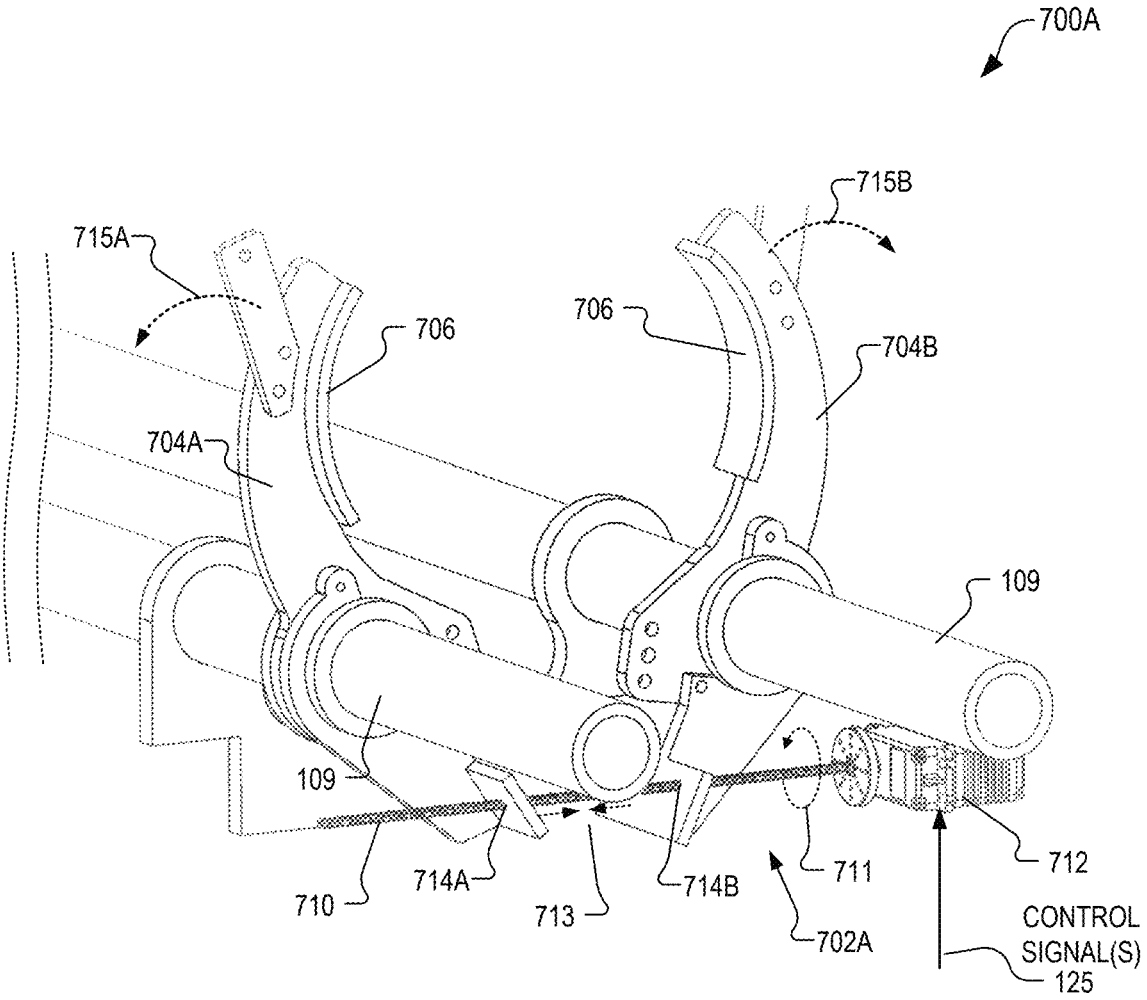
FIG. 7A illustrates a clamping device with an example clamping actuator that includes a lead screw and a motor, in accordance with aspects of the disclosure.

FIG. 7A illustrates a clamping device 700A with an example clamping actuator 702A, in accordance with aspects of the disclosure. Clamping device 700A is shown as including the clamping actuator 702A, a left jaw 704A, a right jaw 704B, and contact pads 706. Clamping actuator 702A is shown as including a lead screw 710, a motor 712, a first threaded interface 714A, and a second threaded interface 714B. Clamping device 700A is one possible implementation of clamping device 112 of FIGS. 1A and 1B. In some aspects, left jaw 704A and right jaw 704B are formed from a rigid material, such as metal. For example, left jaw 704A and right jaw 704B may be aluminum. As shown, each jaw 704A/704B is coupled to a respective support member 109. As mentioned above, the support members may be round tubular metal. Thus, in this example, each support member 109 may pass through a respective through-hole of a jaw 704A/704B for rotatably mounting the jaws to the support members 109. For example, left jaw 704A may be rotatably mounted to a respective support member 109 to allow rotation 715A of the left jaw 704A about a circumference of its respective support member 109. Similarly, right jaw 704B may be rotatably mounted to another respective support member 109 to allow rotation 715B about a circumference of its respective support member 109. In operation, the clamping actuator 702A is configured to rotate the left jaw 704A and the right jaw 704B away from one another to transition the clamping device 700A from a closed state to an open state in response to the at least one control signal 125 (e.g., clamp control signal 339).

As further shown in FIG. 7A, jaws 704A/704B each include at least one contact pad 706. Contact pads 706 are configured to contact the surface of the unmanned water-based deployable (e.g., exterior surface 132 of FIG. 1A) when the clamping device 700A is in the closed state. In some aspects, contact pads 706 include a high-friction material, such as rubber. In addition, when in the closed state, the left jaw 704A and the right jaw 704B, together, provide a clamping area that substantially conforms to and envelopes a cross-section of the unmanned water-based deployable. For example, FIG. 7A illustrates left jaw 704A and 704B providing a circular clamping area that conforms to the circular cross-section of a particular unmanned water-based deployable (e.g., see circular cross-section of deployable 130 of FIG. 1A). However, in other examples, jaws 704A/704B may be configured to provide a regular or irregularly-shaped clamping area depending on the cross-sectional shape of a corresponding deployable that is intended to be remotely launched (e.g., oval, hexagonal, etc.).

Motor 712 may be an electric motor that is coupled to cradle 104 (not shown in FIG. 7A). Motor 712 is configured and coupled to rotate the lead screw 710 in response to the one or more control signals 125 (e.g., clamp control signal 339). As shown in FIG. 7A, jaws 704A/704B each include a respective threaded interface 714A/714B that are each threaded onto corresponding threads of the lead screw 710. In some examples, threaded interface 714B is reverse threaded with respect to threaded interface 714A. In operation, rotation 711 of the lead screw 710 drives the first threaded interface 714A and the second threaded interface 714B along the corresponding threads of the lead screw 710 in opposite directions 713. Movement of the threaded interfaces 714A/714B in opposite directions 713 causes rotation of the left jaw 704A and the right jaw 704B away from one another (e.g., left jaw 704A rotates in a first direction 715A and right jaw 704B rotates in a second direction 715B).

Figure 7B:
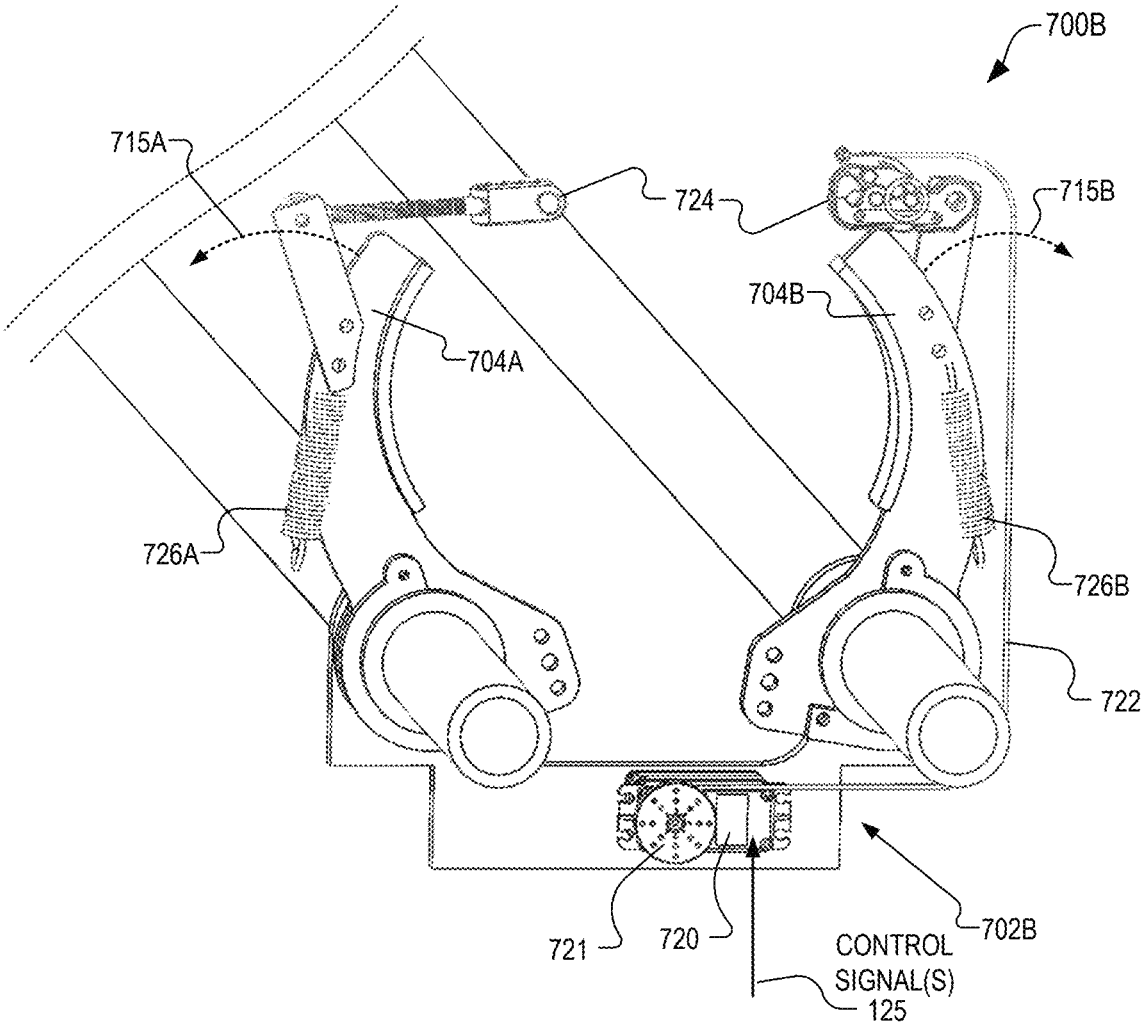
FIG. 7B illustrates a clamping device with an example clamping actuator that includes a latching device, in accordance with aspects of the disclosure.

FIG. 7B illustrates a clamping device 700B with an example clamping actuator 702B, in accordance with aspects of the disclosure. Clamping device 700B is shown as including the clamping actuator 702B, left jaw 704A, and right jaw 704B. Clamping actuator 702B is shown as including a motor 720, a wheel horn 721, a linkage 722, a latch 724, a first spring 726A, and a second spring 726B. Clamping device 700B is one possible implementation of clamping device 112 of FIGS. 1A and 1B.

As shown in FIG. 7B, spring 726A is coupled to left jaw 704A and spring 726B is coupled to right jaw 704B. In some examples, springs 726A/726B are coil springs that are configured to rotatably bias the left jaw 704A and the right jaw 704B away from one another. For example, spring 726A is shown as coupled to rotatably bias left jaw 704A in a first direction 715A. Similarly, spring 726B is coupled to rotatably bias right jaw 704B in a second direction 715B.

When clamping device 700B is in the closed state, the springs 726A and 726B may be extended: biasing their respective jaws outwardly. As shown, the clamping device 700B also includes latch 724 that secures the left jaw 704A to the right jaw 704B when clamping device 700B is in the closed state. The latch 724 is configured to release in response to the one or more clamping signals 125 (e.g., clamp control signal 339) to enable to springs 726A and 726B to rotate the jaws 704A/704B to the open state.

For example, FIG. 7B illustrates a motor 720 that may be mounted to the cradle 104 (not shown in FIG. 7B). The motor 720 may be an electric motor that is configured to be activated in response to the control signal 125. The wheel horn 721 is coupled to the motor 720 to be rotated when the motor 720 is activated. The linkage 722 (e.g., wire, rope, cable, etc.) is coupled between the wheel horn 721 and a release mechanism of latch 724. When activated, the motor 720 rotates the wheel horn 721, which tensions the linkage 722 to release the latch 724. As mentioned above, when latch 724 is released, left jaw 704A is no longer secured to the right jaw 704B, allowing the springs 726A/726B to rotate jaws 704A/704B in directions 715A/715B, respectively.

Figure 7C:
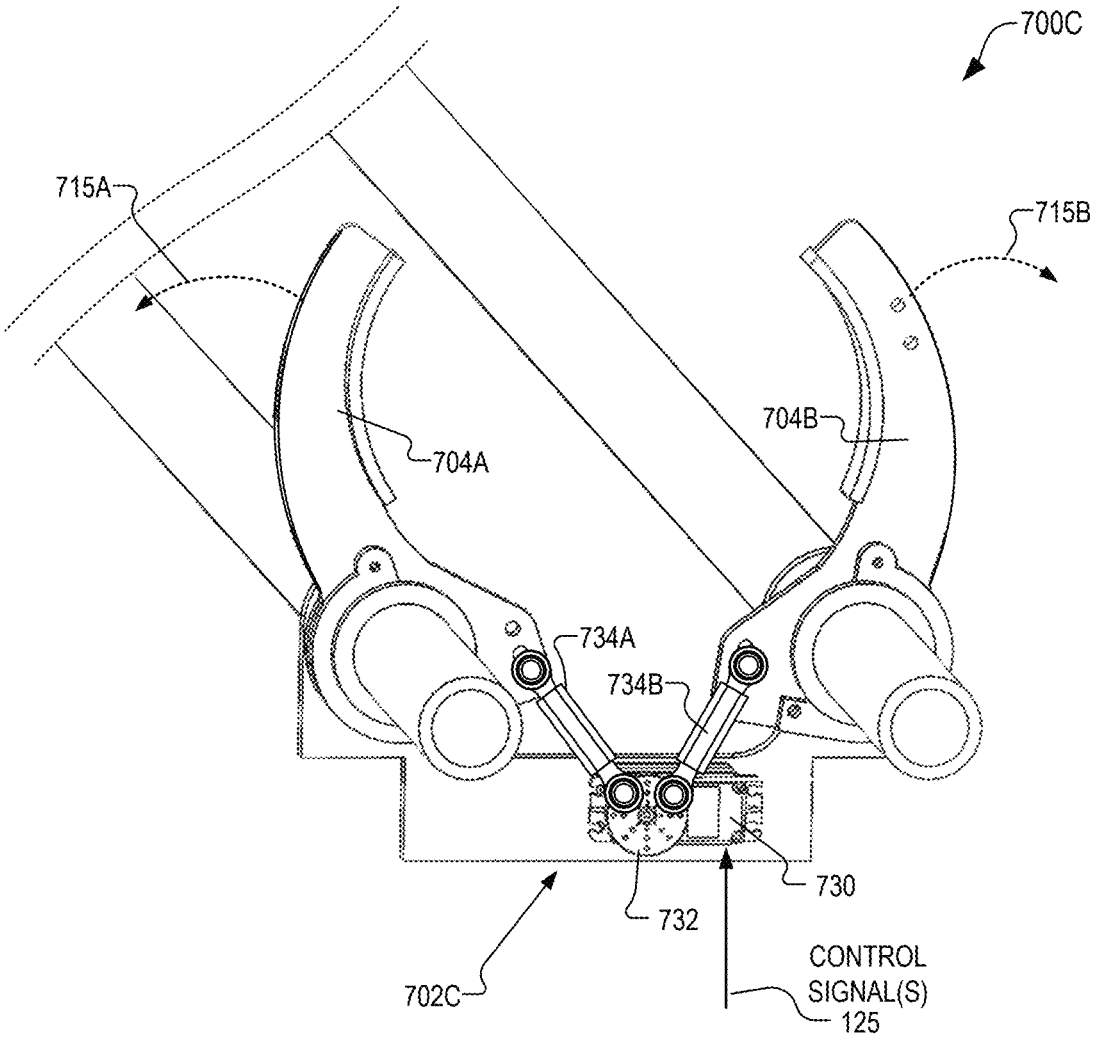
FIG. 7C illustrates a clamping device with an example clamping actuator that includes a wheel horn, motor, and arms, in accordance with aspects of the disclosure.

FIG. 7C illustrates a clamping device 700C with an example clamping actuator 702C, in accordance with aspects of the disclosure. Clamping device 700C is shown as including the clamping actuator 702C, left jaw 704A, and right jaw 704B. Clamping actuator 702C is shown as including a motor 730, a wheel horn 732, a left arm 734A, and a right arm 734B. Clamping device 700C is one possible implementation of clamping device 112 of FIGS. 1A and 1B.

As shown in FIG. 7C, left arm 734A includes one end rotatably coupled to wheel horn 732 and another end (distal end) rotatably coupled to left jaw 704A. Similarly, right arm 734B includes one end rotatably coupled to wheel horn 732 and another end (distal end) rotatably coupled to the right jaw 704B. In some examples, first arm 734A and second arm 734B are heim joints and are configured to rotate the left jaw 704A and the right jaw 704B away from one another as the wheel horn 732 rotates.

For example, FIG. 7C illustrates a motor 730 that may be mounted to the cradle 104 (not shown in FIG. 7C). The motor 730 may be an electric motor that is configured to be activated in response to the control signal 125. The wheel horn 732 is coupled to the motor 730 to be rotated when the motor 730 is activated. When activated, the motor 730 rotates the wheel horn 732, where arms 734A/734B then rotate jaws 704A/704B in opposite directions 715A/715B.

Figure 7D:
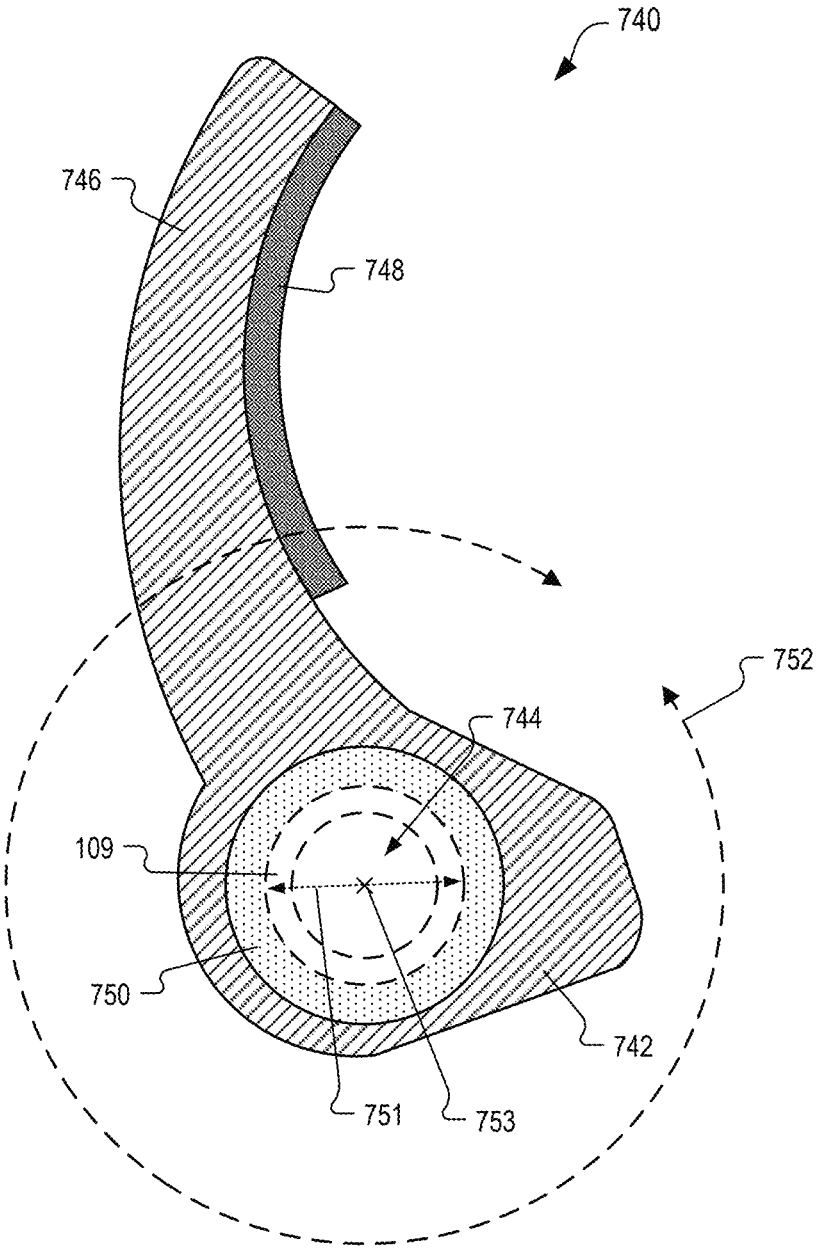
FIG. 7D illustrates an example jaw for use with a clamping device, in accordance with aspects of the disclosure.

FIG. 7D illustrates an example jaw 740 for use with a clamping device, in accordance with aspects of the disclosure. Jaw 740 is one possible implementation of any of the jaws discussed herein, including jaws 704A and 704B of FIGS. 7A-7C. Jaw 740 is shown as including a mounting portion 742, a through hole 744, a contact pad support portion 746, a contact pad 748, and a support member interface 750. Also shown in FIG. 7D is support member 109.

As mentioned above, in some examples, support members 109 of a cradle (e.g., cradle 104 of FIGS. 1A and 1B) may be a round tubular material, where a jaw of a clamping device is configured to mount on the support member 109. Thus, the mounting portion 742 of the example jaw 740 includes a through-hole 744 that is sized to slide onto or otherwise receive a support member 109. For example, FIG. 7D illustrates support member 109 as having an exterior diameter 751. Thus, in this example, through-hole 744 may have an interior diameter that is the same or slightly larger than diameter 751. Mounting portion 742 is also shown as including a support member interface 750. In some examples, support member interface 750 is disposed between the material of the mounting portion 742 and the support member 109 to allow the jaw 740 to rotate about the support member 109 (e.g., see rotation 752 about axis 753 of support member 109 of FIG. 7D). In some aspects, support member interface 750 is a rotary bearing and may include one or more ball bearings. In another aspect, support member interface 750 is a plain (or sliding contact) bearing, such as a bushing (e.g., solid, split, clenched, etc.).

Figure 8:
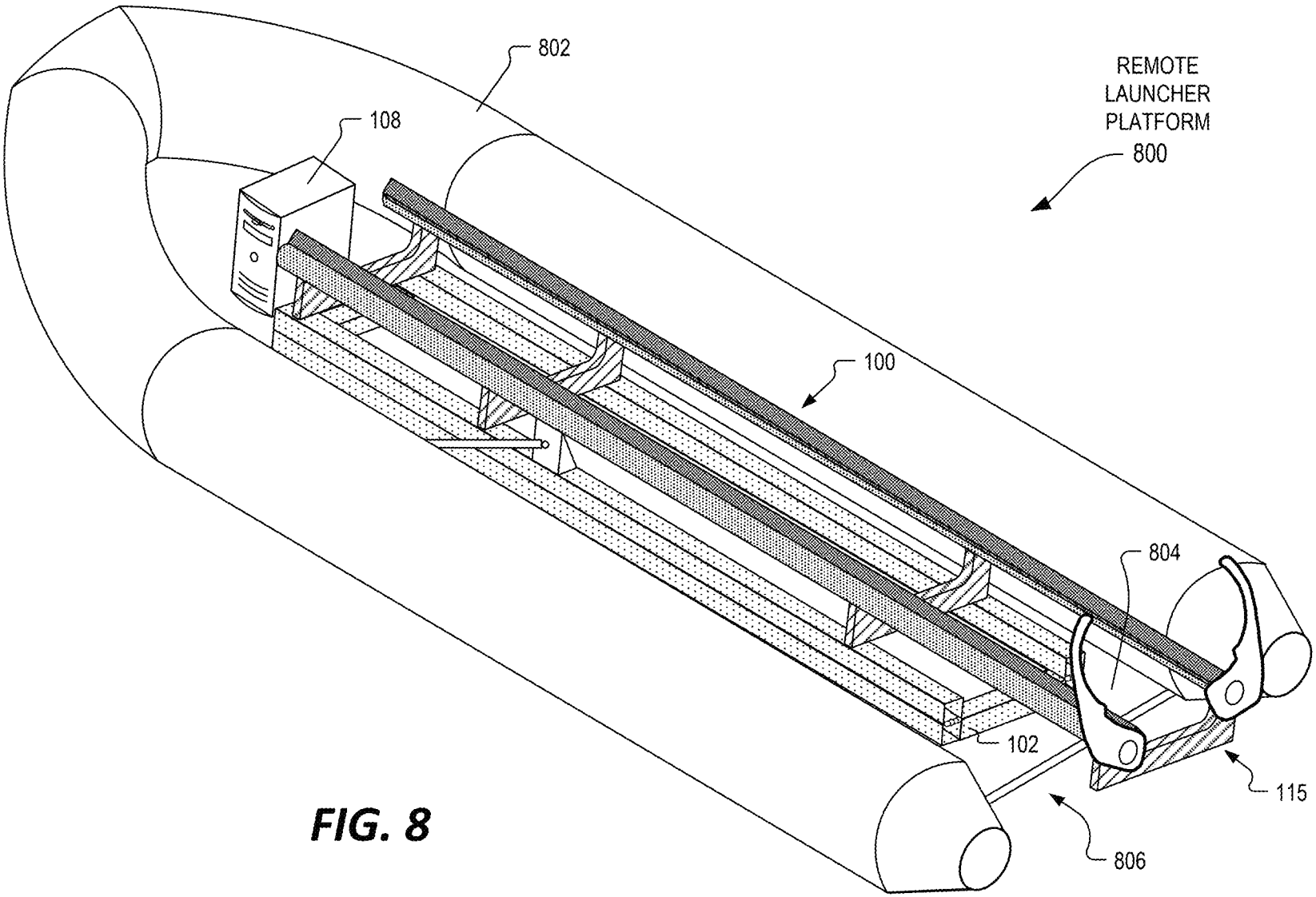
FIG. 8 illustrates an example remote launcher platform, in accordance with aspects of the disclosure.

FIG. 8 illustrates an example remote launcher platform 800, in accordance with aspects of the disclosure. Remote launcher platform 800 is shown as including remote launcher 100 and a USV 802. USV 802 is shown as including a deck 804 having a water-accessible end 806.

In some examples, USV 802 is a remote operated vehicle (ROV) that is configured to provide real-time telemetry and allow user interaction (e.g., via USV control module 330 of FIG. 3). In other examples, USV 802 is an autonomous surface vehicle that is untethered and configured to perform and operate with limited user intervention. USV 802 may further include a propulsor (not shown in FIG. 8), which may be a propeller, an impeller, a thruster, or other means for self-propelling USV 802 through the water.

FIG. 8 further illustrates remote launcher 100 as being disposed on the deck 804 of the USV 802. In some examples, the remote launcher 100 is disposed on the deck 804 with the hinged end 115 facing, or closest to, a water-accessible end 806 of the deck 804. In some examples, the water-accessible end 806 of the deck 804 is an aft portion of the USV 802. The water-accessible end 806 may also be configured with a reduced or minimal height to allow easier egress into the water. In some examples, the base frame 102 is disposed directly on the deck 804. In other examples, remote launcher 100 may include spacers, shock absorbers, pads, and/or mounting features between the base frame 102 and the deck 804.

Figure 9A:
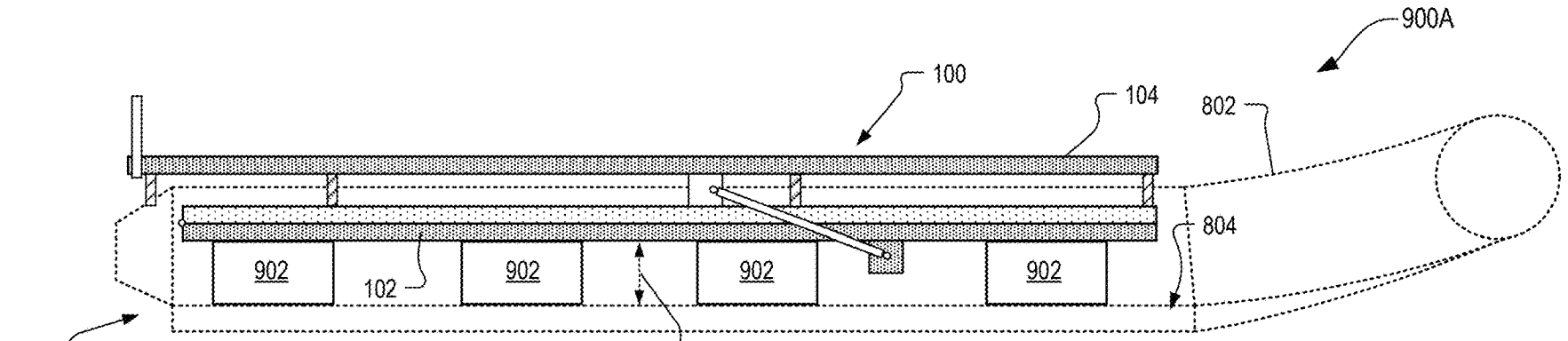
FIG. 9A illustrates an example remote launcher platform with a cradle in a stowed position, in accordance with aspects of the disclosure.
Figure 9B:
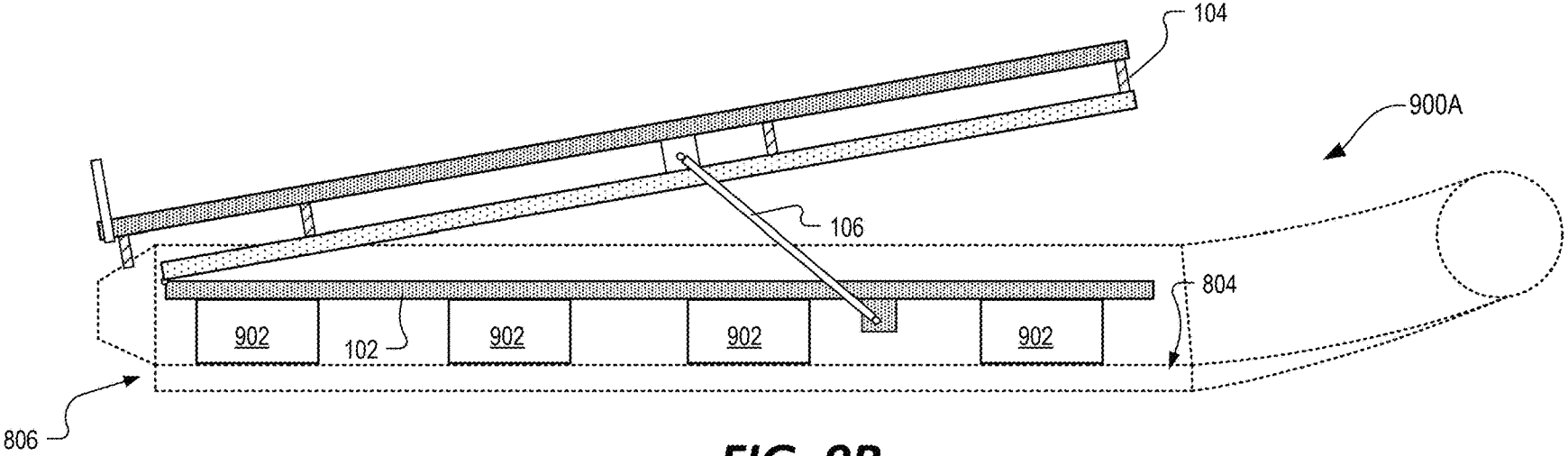
FIG. 9B illustrates the remote launcher platform of FIG. 9A with the cradle in a launch position.

For example, FIG. 9A illustrates an example remote launcher platform 900A having spacers 902 and with cradle 104 in a stowed position, in accordance with aspects of the disclosure. FIG. 9B illustrates the remote launcher platform 900A of FIG. 9A with the cradle 104 in a launch position. In some aspects, spacers 902 are blocks, additional metal framing, and/or other material disposed between the base frame 102 and the deck 804 to elevate the remote launcher 100 within the USV 900A. For example, FIGS. 9A and 9B illustrates spacers 902 as having a height 904. In some examples, height 904 may be configured to allow egress of the deployable over any physical obstacles that may be present at the water-accessible end 806 of the deck 804. Although FIGS. 9A and 9B illustrate remote launcher 100 as including four (4) spacers 902, any number of spacers 902 may be used with remote launcher 100, including one or more.

Figure 9C:
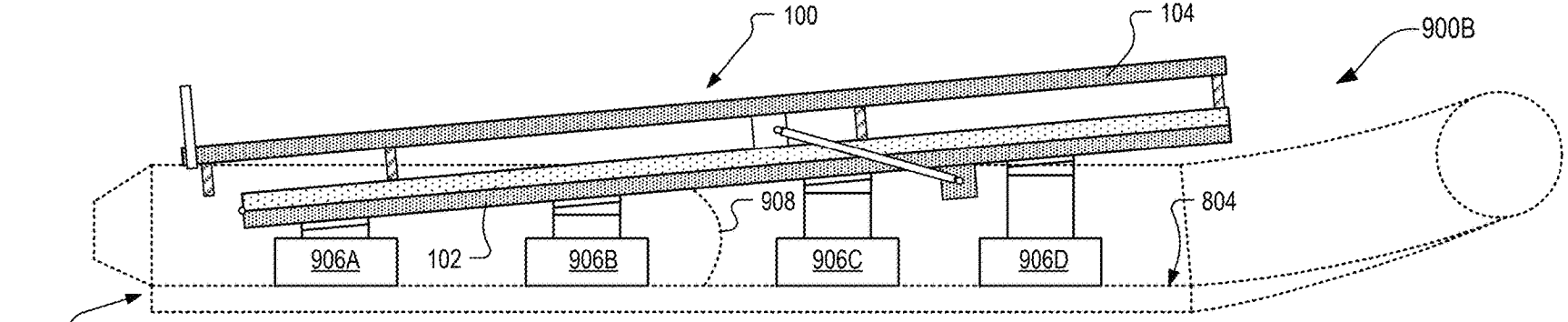
FIG. 9C illustrates an example remote launcher platform having graduated spacers and with a cradle in a stowed position, in accordance with aspects of the disclosure.
Figure 9D:
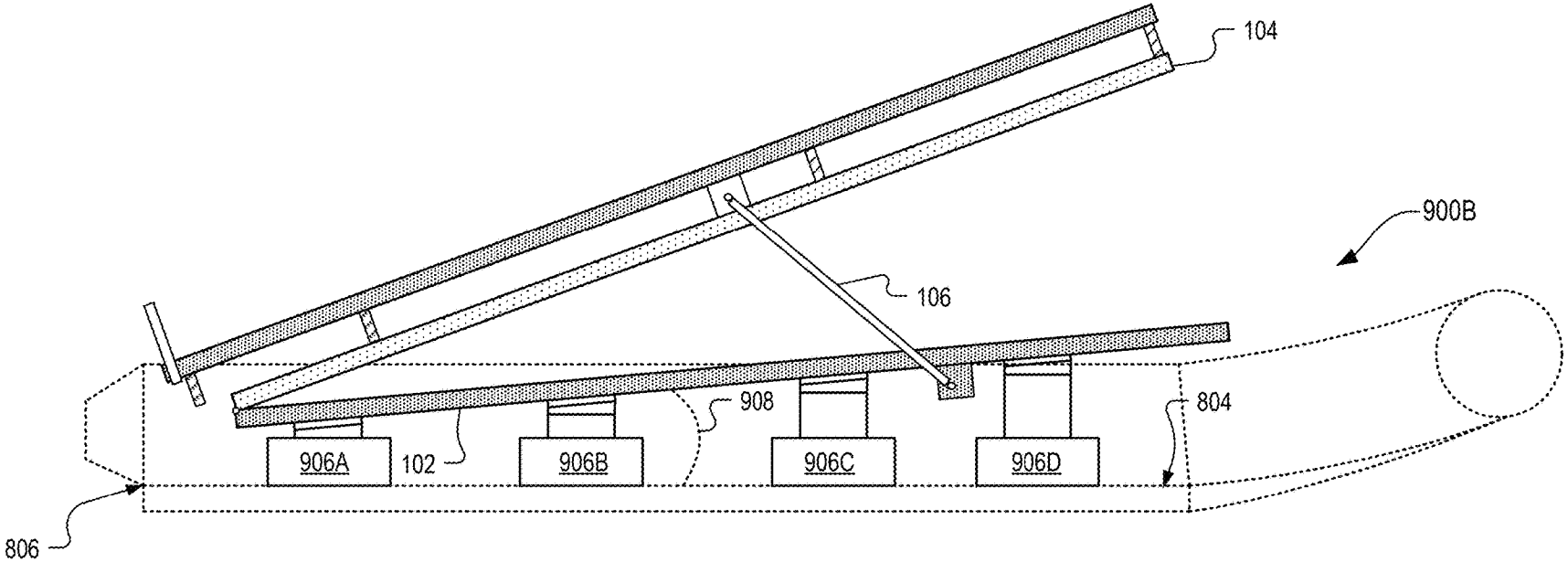
FIG. 9D illustrates the remote launcher platform of FIG. 9C with the cradle in a launch position.
Figure 9E:
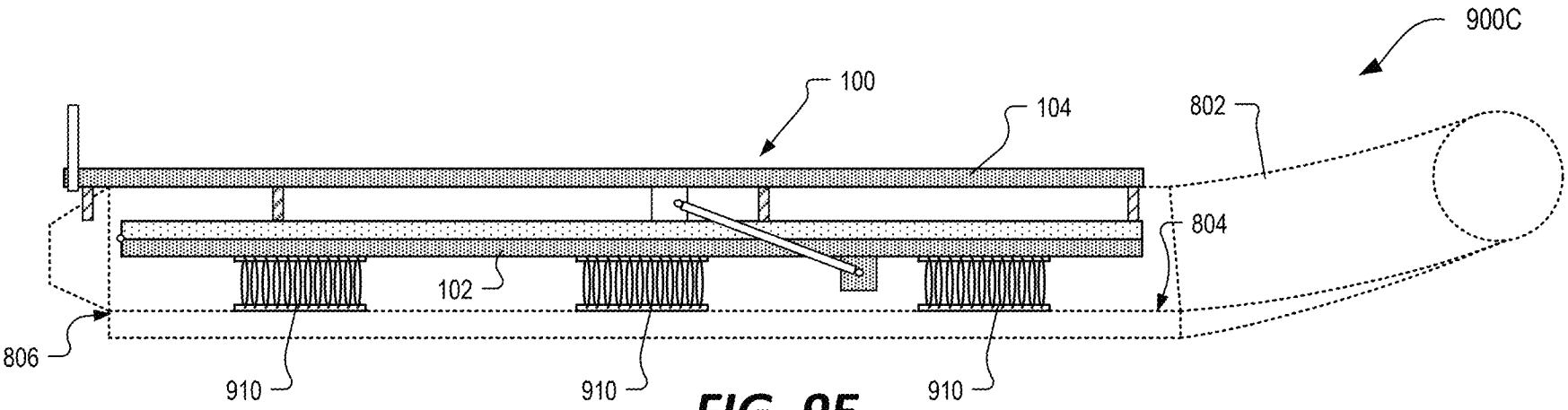
FIG. 9E illustrates an example remote launcher platform having wire-rope isolators and with a cradle in a stowed position, in accordance with aspects of the disclosure.

FIG. 9C illustrates an example remote launcher platform 900B having graduated spacers 904A-904D and with cradle 104 in a stowed position, in accordance with aspects of the disclosure. FIG. 9D illustrates the remote launcher platform 900B of FIG. 9C with the cradle 104 in a launch position. In some aspects, spacers 906A-906D are blocks, additional metal framing, and/or other material disposed between the base frame 102 and the deck 804 to fixedly incline the base frame 102 with respect to the deck 804 towards the water-accessible end 806. For example, FIGS. 9D and 9E illustrate graduated spacers 906A-906D of varying heights (e.g., spacer 906D is taller than spacer 906C, which is taller than spacer 906B, which is taller than spacer 906A, etc.). The varying heights of the graduated spacers 906A-906D are shown as fixedly inclining the base frame 102 to an angle 908 with respect to the deck 804. In some aspects, having the base frame 102 fixedly inclined at angle 908 may reduce the amount that cradle actuator 106 may need to incline the cradle 104 to initiate a gravity-assisted launch of the unmanned water-based deployable. For example, assuming a total incline of 45 degrees is necessary to launch a deployable off of the cradle 104, then having a fixed incline angle 908 of 15 degrees would mean that the cradle actuator 106 only needs to incline the cradle 104 an additional 30 degrees, as opposed to the entire 45 degrees. Although FIGS. 9C and 9D illustrate remote launcher 100 as including four (4) graduated spacers 906A-906D, any number of graduated spacers may be used with remote launcher 100, including one or more, to provide the fixed incline angle 908.

Figure 9F:
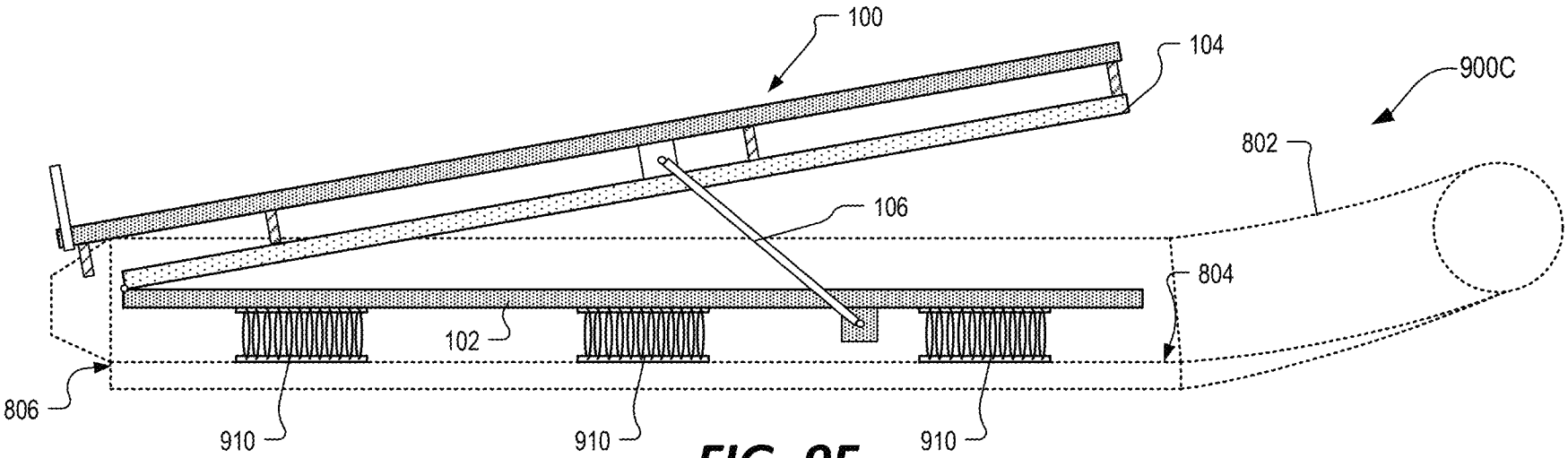
FIG. 9F illustrates the remote launcher platform of FIG. 9E with the cradle in a launch position.

FIG. 9E illustrates an example remote launcher platform 900C having wire-rope isolators 910 and with cradle 104 in a stowed position, in accordance with aspects of the disclosure. FIG. 9F illustrates the remote launcher platform 900C of FIG. 9E with the cradle 104 in a launch position. In some aspects, an unmanned water-based deployable may include sensors, equipment, or other features that are susceptible to damage and/or misalignment during transportation. Accordingly, the FIGS. 9E and 9F illustrate remote launcher 100 as including one or more wire-rope isolators 910 disposed between the base frame 102 and the deck 804. Wire-rope isolators 910 are configured to dampen or control vibrations between the USV 802 and the unmanned water-based deployable (e.g., deployable 130 of FIG. 1A) that may be transported on the cradle 104. Wire-rope isolators 910 may be helical, half-helical, and/or polycal type isolators.

The processes, methods, functions, or modules explained above may be implemented in hardware, software, firmware, or any combination thereof. If implemented in software, the techniques may be stored on or transmitted as one or more instructions or code on a computer-readable medium. The techniques described may constitute computer-executable instructions embodied or stored within a tangible or non-transitory computer-readable medium, that when executed by a processor will cause the processor to perform the operations or acts described. Additionally, the processes may be embodied within hardware, such as an application specific integrated circuit ("ASIC") or otherwise.

A tangible non-transitory computer-readable medium includes any mechanism that provides (i.e., stores) information in a form accessible by a machine (e.g., a computer, network device, personal digital assistant, manufacturing tool, any device with a set of one or more processors, etc.). For example, a machine-readable medium may include recordable or non-recordable media (e.g., read only memory (ROM), random access memory (RAM), magnetic disk storage media, optical storage media, flash memory devices, etc.).

In addition, the methods disclosed herein comprise one or more steps or actions for achieving the described method. The method steps and/or actions may be interchanged with one another without departing from the scope of the claims. In other words, unless a specific order of steps or actions is specified, the order and/or use of specific steps and/or actions may be modified without departing from the scope of the claims.

The above description of illustrated embodiments of the invention, including what is described in the Abstract, is not intended to be exhaustive or to limit the invention to the precise forms disclosed. While specific embodiments of, and examples for, the invention are described herein for illustrative purposes, various modifications are possible within the scope of the invention, as those skilled in the relevant art will recognize.

These modifications can be made to the invention in light of the above detailed description. The terms used in the following claims should not be construed to limit the invention to the specific embodiments disclosed in the specification. Rather, the scope of the invention is to be determined entirely by the following claims, which are to be construed in accordance with established doctrines of claim interpretation.

What is claimed is:

1. A remote launcher for an unmanned water-based deployable, the remote launcher comprising:

a base frame;

a cradle pivotably coupled to the base frame, wherein the cradle includes one or more skids configured to receive and support the unmanned water-based deployable;

a cradle actuator coupled to the base frame and to the cradle; and a launch control system that includes:

a communication interface;

at least one processor coupled to the communication interface; and at least one memory coupled to the at least one processor, the at least one memory having instructions stored thereon, which when executed by the at least one processor, direct the launch control system to:

receive, via the communication interface, one or more wireless launch signals; and generate at least one cradle control signal in response to the one or more wireless launch signals to enable the cradle actuator to incline the cradle to a launch angle.

2. The remote launcher of claim 1, wherein the cradle actuator comprises a motorized linear actuator that is configured to incline the cradle responsive to the at least one cradle control signal.

3. The remote launcher of claim 1, further comprising at least one latching device coupled to secure the cradle to the base frame, wherein the at least one latching device is configured to release in response to the at least one cradle control signal to allow the cradle to incline to the launch angle.

4. The remote launcher of claim 3, wherein the cradle actuator comprises a spring, coupled to the base frame and to the cradle to bias the cradle towards the launch angle.

5. The remote launcher of claim 4, wherein the spring comprises a gas spring or a coil spring.

6. The remote launcher of claim 1, wherein the cradle includes a clamping device positioned to secure the unmanned water-based deployable to the cradle, and wherein the at least one memory further includes instructions, which when executed by the at least one processor, direct launch control system to:

generate at least one clamp control signal in response to the one or more wireless launch signals to transition the clamping device from a closed state that secures the unmanned water-based deployable to the cradle to an open state that allows the unmanned water-based deployable to freely traverse the one or more skids.

7. The remote launcher of claim 6, wherein the clamping device comprise a high-friction material disposed to contact a surface of the unmanned water-based deployable when the clamping device is in the closed state.

8. The remote launcher of claim 6, wherein the clamping device includes:

a left jaw and a right jaw that, together, provide a clamping area that substantially conforms to and envelopes a cross-section of the unmanned water-based deployable; and a clamping actuator coupled to the left jaw and the right jaw to rotate the left jaw and the right jaw away from one another to transition to the open state in response to the at least one clamp control signal.

9. The remote launcher of claim 8, wherein the clamping device further includes at least one latching device coupled to secure the left jaw to the right jaw when clamping device is in the closed state to secure the unmanned water-based deployable to the cradle, wherein the at least one latching device is configured to release in response to the at least one clamp control signal to allow the right jaw and the left jaw to rotate away from one another.

10. The remote launcher of claim 9, wherein the clamping device further comprises at least one spring, coupled to rotatably bias the left jaw and the right jaw away from one another.

11. The remote launcher of claim 8, wherein the clamping actuator comprises:

a lead screw; and a motor coupled to rotate the lead screw in response to the at least one clamp control signal, wherein the left jaw includes a first threaded interface threaded onto corresponding threads of the lead screw; and the right jaw includes a second threaded interface threaded onto corresponding threads of the lead screw, wherein rotation of the lead screw drives the first threaded interface and the second threaded interface along the corresponding threads of the lead screw to rotate the left jaw and the right jaw away from one another.

12. The remote launcher of claim 8, wherein the clamping actuator comprises:

a wheel horn;

a motor coupled to rotate the wheel horn in response to the at least one clamp control signal;

a first arm having:

a first end rotatably coupled to the wheel horn, and a second end rotatably coupled to the left jaw; and a second arm having:

a first end rotatably coupled to the wheel horn, and a second end rotatably coupled to the right jaw, wherein rotation of the wheel horn translates to the first arm and the second arm rotating the left jaw and the right jaw away from one another.

13. The remote launcher of claim 8, wherein the one or more skids comprise a low-friction material disposed on a round tubular support member, and wherein at least one of the left jaw or right jaw of the clamping device further comprises:

a mounting portion that includes a through-hole coupled to receive the round tubular support member and to rotate the jaw about the round tubular support member; and a contact pad support portion coupled to the mounting portion, wherein the contact pad support portion comprises at least one contact pad that includes a high-friction material configured to contact an exterior surface of the unmanned water-based deployable when the clamping device is in the closed state.

14. The remote launcher of claim 1, further comprising:

a camera communicatively coupled to the launch control system and positioned to capture one or more images of at least one of the cradle or the unmanned water-based deployable, wherein the at least one memory further includes instructions, which when executed by the at least one processor, direct launch control system to:

receive the one or more images captured by the camera;

wirelessly transmit the one or more images, via the communication interface, to a main control platform; and receive, via the communication interface, one or more subsequent wireless launch signals generated by the main control platform in response to the one or more images.

15. The remote launcher of claim 1, wherein the unmanned water-based deployable comprises an unmanned underwater vehicle (UUV), an unmanned surface vehicle (USV), a buoy, or a transponder.

16. The remote launcher of claim 15, wherein the launch angle is greater than a minimum angle necessary to overcome a coefficient of friction between the unmanned water-based deployable and the low-friction material of the one or more skids.

17. A remote launcher platform for an unmanned water-based deployable, the remote launcher platform comprising:

an unmanned surface vehicle (USV) that includes a deck, wherein the deck includes a water-accessible end; and a remote launcher onboard the USV, wherein the remote launcher comprises:

a base frame disposed on the deck;

a cradle pivotably coupled to the base frame, wherein the cradle includes one or more skids configured to receive and support the unmanned water-based deployable;

a cradle actuator coupled to the base frame and to the cradle; and a launch control system that includes:

a communication interface;

at least one processor coupled to the communication interface; and at least one memory coupled to the at least one processor, the at least one memory having instructions stored thereon, which when executed by the at least one processor, direct the launch control system to:

receive, via the communication interface, one or more wireless launch signals; and generate at least one cradle control signal in response to the one or more wireless launch signals to enable the cradle actuator to incline the cradle towards the water-accessible end of the deck.

18. The remote launcher platform of claim 17, wherein the remote launcher further comprises:

a plurality of graduated spacers disposed between the base frame and the deck to fixedly incline the base frame with respect to the deck, towards the water-accessible end of the deck.

19. The remote launcher platform of claim 17, wherein the remote launcher further comprises:

one or more wire-rope isolators disposed between the base frame and the deck to dampen or control vibrations between the USV and the unmanned water-based deployable.

20. A remote launch system, comprising:

a main control platform that includes:

a first communication interface;

a first processor coupled to the first communication interface; and a first memory coupled to the first processor, the first memory having instructions stored thereon, which when executed by the first processor, direct the main control platform to:

generate a launch signal, configured to initiate the remote launch of a unmanned underwater vehicle (UUV);

transmit the launch signal, via the first communication interface to an air interface; and a remote launcher platform that includes:

an unmanned surface vehicle (USV) that includes a deck, wherein the deck includes a water-accessible end;

a remote launcher onboard the USV, wherein the remote launcher comprises:

a base frame disposed on the deck;

a cradle pivotably coupled to the base frame, wherein the cradle includes one or more skids configured to receive and support the UUV;

a cradle actuator coupled to the base frame and to the cradle; and a launch control system that includes:

a second communication interface;

a second processor coupled to the second communication interface; and a second memory coupled to the second processor, the second memory having instructions stored thereon, which when executed by the second processor, direct the launch control system to:

receive, by the second communication interface, the launch signal on the air interface; and generate at least one cradle control signal in response to the launch signal to enable the cradle actuator to incline the cradle towards the water-accessible end of the deck at a launch angle large enough to initiate a gravity-assisted transit of the UUV along the one or more skids towards the water-accessible end of the deck and off of the USV.

* * * * *